US012674632B2

(12) United States Patent
Sorensen et al.

(10) Patent No.: US 12,674,632 B2
(45) Date of Patent: Jul. 7, 2026

(54) REFRIGERANT HEAT EXCHANGER WITH INTEGRAL MULTIPASS AND FLOW DISTRIBUTION TECHNOLOGY

(71) Applicant: Intergalactic Spaceworx, LLC, St. George, UT (US)

(72) Inventors: Cole Sorensen, Hurricane, UT (US); Andrew Kerlin, St. George, UT (US)

(73) Assignee: Intergalactic Spaceworx, LLC, St. George, UT (US)

( * ) Notice: Subject to any disclaimer, the term of this patent is extended or adjusted under 35 U.S.C. 154(b) by 133 days.

(21) Appl. No.: 18/559,399

(22) PCT Filed: May 19, 2022

(86) PCT No.: PCT/US2022/029990

§ 371 (c)(1),
(2) Date: Nov. 7, 2023

(87) PCT Pub. No.: WO2022/246038

PCT Pub. Date: Nov. 24, 2022

(65) Prior Publication Data

US 2024/0230250 A1 Jul. 11, 2024

Related U.S. Application Data

(60) Provisional application No. 63/190,843, filed on May 20, 2021.

(51) Int. Cl.

| | |
|---|---|
| ***F28F 9/02*** | (2006.01) |
| ***F28D 7/16*** | (2006.01) |
| *F28D 21/00* | (2006.01) |

(52) U.S. Cl.

CPC ..... *F28F 9/0248* (2013.01); *F28D 7/1638* (2013.01); *F28F 9/0204* (2013.01); *F28D 2021/0068* (2013.01); *F28F 2260/02* (2013.01)

(58) Field of Classification Search

CPC ..... F28D 7/1638; F28D 7/1646; F28D 9/0226

See application file for complete search history.

(56) References Cited

U.S. PATENT DOCUMENTS

| | | | |
|---|---|---|---|
| 4,386,652 A | 6/1983 | Dragojevic | |
| 4,676,305 A | 6/1987 | Doty | |

(Continued)

FOREIGN PATENT DOCUMENTS

| | | | |
|---|---|---|---|
| CH | 698756 B1 * | 10/2009 | ..... F28D 7/1638 |
| EP | 0191602 A2 | 8/1986 | |

(Continued)

OTHER PUBLICATIONS

Examination Report for GB2319038.2 dated Oct. 4, 2024.

(Continued)

*Primary Examiner* — Eric S Ruppert

(74) *Attorney, Agent, or Firm* — McGarry Bair PC

(57) ABSTRACT

A heat exchanger including a tube stack having a plurality of microtubes; a first header coupled with a heat exchanger refrigerant fluid inlet and configured to introduce refrigerant fluid traveling in a first direction into the tube stack; and a second header coupled to a heat exchanger refrigerant fluid outlet and having a second header passage configured to receive refrigerant fluid traveling in the first direction through some of the microtubes and discharge the received refrigerant fluid in a second direction to some of the microtubes. The first header has a first header passage configured to receive refrigerant fluid traveling in the second direction and discharge the received refrigerant fluid in the first direction to some of the microtubes. The second header further configured to receive refrigerant fluid traveling in the first direction and discharge the received refrigerant to the heat exchanger refrigerant fluid outlet.

10 Claims, 15 Drawing Sheets

(56) References Cited

U.S. PATENT DOCUMENTS

| | | | |
|---|---|---|---|
| RE33,528 | E | 1/1991 | Doty |
| 6,415,860 | B1 | 7/2002 | Kelly et al. |
| 6,892,802 | B2 | 5/2005 | Kelly et al. |
| 6,983,790 | B2 | 1/2006 | Ippoushi et al. |
| 6,986,382 | B2 | 1/2006 | Upadhya et al. |
| 7,131,553 | B2 | 11/2006 | Sanders |
| 7,434,411 | B2 | 10/2008 | Drost et al. |
| 7,562,697 | B2 | 7/2009 | Gorbounov et al. |
| 7,757,753 | B2 | 7/2010 | Yanik et al. |
| 7,775,031 | B2 | 8/2010 | Wood |
| 8,171,987 | B2 | 5/2012 | Jiang et al. |
| 8,177,932 | B2 | 5/2012 | Becnel et al. |
| 8,230,594 | B1 | 7/2012 | Bossard et al. |
| 8,262,978 | B1 | 9/2012 | Wapner et al. |
| 9,039,814 | B2 | 5/2015 | Bossard |
| 9,500,414 | B2 | 11/2016 | Tonkovich et al. |
| 9,562,464 | B2 | 2/2017 | Keene et al. |
| 10,006,369 | B2 | 6/2018 | Kupiszewski |
| 10,914,527 | B2 | 2/2021 | Jekerle |
| 11,859,921 | B1 | 1/2024 | Kelly et al. |
| 2003/0029040 | A1 | 2/2003 | Cesaroni et al. |
| 2004/0206109 | A1 | 10/2004 | Nishiwaki et al. |
| 2006/0120213 | A1 | 6/2006 | Tonkovich et al. |
| 2010/0230081 | A1 | 9/2010 | Becnel et al. |
| 2010/0282439 | A1 | 11/2010 | Summerer |
| 2012/0175095 | A1 | 7/2012 | Makhlouf et al. |
| 2012/0199327 | A1 | 8/2012 | Gaiser |
| 2012/0211158 | A1 | 8/2012 | Becnel et al. |
| 2013/0292104 | A1 | 11/2013 | Park et al. |
| 2016/0301084 | A1 | 10/2016 | Gendel et al. |
| 2017/0003039 | A1 | 1/2017 | Lazzari |
| 2018/0073809 | A1 | 3/2018 | Kang et al. |
| 2018/0164045 | A1 | 6/2018 | Alahyari et al. |
| 2018/0252480 | A1 | 9/2018 | Kolb |
| 2018/0292137 | A1 | 10/2018 | Bauckhage |
| 2019/0011187 | A1 | 1/2019 | Bucknell |
| 2019/0017757 | A1 | 1/2019 | Seeholzer et al. |
| 2019/0219337 | A1* | 7/2019 | Twelves ..... F28D 7/1623 |
| 2019/0339027 | A1 | 11/2019 | Takafuji |
| 2020/0096259 | A1 | 3/2020 | Pearson et al. |

FOREIGN PATENT DOCUMENTS

| | | | |
|---|---|---|---|
| EP | 0284463 | | 9/1988 |
| EP | 0284463 | A1 | 9/1988 |
| EP | 2278246 | A2 | 1/2020 |
| JP | WO1991000980 | A1 * | 1/1991 |
| KR | 101727276000 | | 4/2017 |
| WO | WO2012006073 | A3 | 1/2012 |
| WO | 2020245836 | A1 | 10/2020 |

OTHER PUBLICATIONS

Mezzo Microchannel Radiator Wins Borgwarner Louis Schwitzer Award, May 21, 2010, https://www.indianapolismotorspeedway.com/news-multimedia/news/2010/05/21/mezzo-microchannel-radiator-wins-borgwarner-louis-schwitzer-award.

Baton Rouge's Mezzo Technologies Looking Beyond Racecar Tracks to Space, Updated Jul. 29, 2019, The Advocate, https://www.theadvocate.com/baton_rouge/news/business/baton-rouge-s-mezzo-technologies-looking-beyond-racecar-tracks-to-space/article_7b8701c7-11e4-5db5-b2be-1238ba3a91e4.html.

ARPA-E Projects to Develop New Technologies for High Performance Heat Exchangers, Components, Mar. 22, 2019, https://www.energy.gov/articles/doe-announces-36-million-high-temperature-materials-projects.

Breedlove et al., Turbo-Brayton Converter for Radioisotope Power Systems, Nuclear and Emerging Technologies for Space, American Nuclear Society Topical Meeting, Richland, WA, Feb. 25-28, 2019.

Izenson et al., Integrated Oxygen Flow Meter/Heat Exchanger for Portable Life Support Systems, 48th International Conference on Environmental Systems, Albuquerque, NM, Jul. 8-12, 2018.

Examination Report for United Kingdom Patent Application No. GB2319038.2 dated Feb. 12, 2025.

Extended European Search Report for EP Patent Application No. 22805462.3 dated May 2, 2025.

ARPA-E Changing What's Possible (project sheet), Aug. 9, 2018, International Mezzo Technologies (arpa-e-comms@hq.doe.gov).

"Increase your performance and sustainability," Reaction Engines Applied Technologies, pp. 1-7, https://reactiontechnologies.co.uk/technologies/.

"Mezzo's PCM Technology Allows NASA to Reduce the Size and Weight of Their Thermal Systems," pp. 1-6, https://www.mezzotech.com.

Beyers, et al., Improved Cover Type Header Box Design Procedure, R&D Journal of South African Institute of Mechanical Engineering, 2015, pp. 76-85 (http://www.saimeche.org.za).

Mezzo Technologies, Why Microtubes? Mezzo has the unique capability to design and manufacture a microtube heat exchanger for a wide range of applications, pp. 1-8 (https://mezzotech.com/why-micro-tubes/—accessed Nov. 6, 2020).

Saffarian et al., Numerical study of shell and tube heat exchanger with different cross-section tubes and combined tubes, Feb. 2019, pp. 1-14 (https://www.researchgate.net/publication/331046793).

Panda, et al., Design study of microchannel heat exchanger headers using experimentally validated multiphase flow CFD simulation, Sep. 2020, vol. 178, pp. 1-3 (https://www.sciencedirect.com/science/article/abs/pii/S1359431120330672).

Morris, M., Mechanical Design of Heat Exchanger, 2002, p. 1 (thermopedia.com/content/946).

Mezzo Technologies, Why Microtubes?: Mezzo Technologies, pp. 1-3 (https://www.mezzotech.com/why-microtubes.html—accessed Jun. 16, 2021).

Mott Corporation, Porous Metal Solutions, Transforming Ordinary Into Extraordinary, pp. 1-8.

ESPACENET translation of WO9100980, 4 pages, accessed Aug. 11, 2025.

* cited by examiner

REFRIGERANT HEAT EXCHANGER WITH INTEGRAL MULTIPASS AND FLOW DISTRIBUTION TECHNOLOGY

CROSS-REFERENCE TO RELATED APPLICATIONS

This application claims the benefit of the filing date of U.S. Provisional Application Ser. No. 63/190,843, filed on May 20, 2021 and entitled "REFRIGERANT HEAT EXCHANGER WITH INTEGRAL MULTIPASS AND FLOW DISTRIBUTION TECHNOLOGY", as well as the entire disclosure of which is hereby incorporated by reference into the present disclosure.

FIELD OF THE INVENTION

The present disclosure relates to microtube heat exchangers. More particularly, the disclosure is most directly related to microtube heat exchangers with headers enabling efficient multi-path refrigerant fluid flow passes.

BACKGROUND

In traditional heat exchangers, the refrigerant fluid entry passageway, such as the hose or tubing leading to a point of entry into the heat exchanger header, has a total cross-sectional area that is smaller than the total cross-sectional area of the channels in the heat exchanger summed together. For example, one entry tube into an aerospace refrigerant microtube heat exchanger might have a cross-sectional area that is $1/10^{th}$ the area of all microtubes summed together.

Refrigerant vapor occupies a disproportionate fraction of available volume immediately following the expansion valve when the working fluid separates into two phases (liquid and vapor) during free expansion. This vapor hinders the working liquid from freely entering all heat exchanger channels with uniform distribution. Refrigerant vapor adds little value to evaporator heat exchanger performance. Refrigerant vapor absorbs negligible heat in an evaporator as the bulk of heat exchange occurs during refrigerant phase change from liquid to vapor (evaporator) or vapor to liquid (condenser).

Traditional refrigerant fluid distribution technology often employs a mixing device or orifice to combine separated two-phase vapor-liquids together and transport via several passageways to the heat exchanger. Some technologies introduce the separated two-phase fluid into an open heat exchanger header, thus further exacerbating the issue with additional expansion and separation. This non-uniform, non-homogenous distribution reduces the overall efficiency of the heat exchanger. Furthermore, current conventional technologies are limited in the number of possible inlet passageways. Such conventional technology cannot be used when a heat exchanger contains thousands of microtubes.

Traditionally, there is no geometry or technology within the heat exchanger headers to solve the issue of refrigerant, which is sensitive to sudden expansion and sudden contraction flow distributions, entering the header and spreading poorly, which creates a regional loss in efficiency. As the refrigerant enters the larger volume of the heat exchanger header, further separation of the two-phase refrigerant within the header often occurs. This separation reduces the overall efficiency of the heat exchanger.

Therefore, despite the well-known characteristics of heat exchanger headers, there are still substantial and persistent unresolved needs for improving fluid flow through a microtube heat exchanger to reduce or eliminate the two-phase separation of the working fluid to improve the overall efficiency of the heat exchanger.

SUMMARY

The innovations of the disclosed embodiments improve the headers in heat exchanger assemblies by incorporating geometries for highly efficient flow management. This technology ensures the microtube heat exchanger functional cross-sectional area is divided into sections that are nearly identical to the cross-sectional area of the entry port of the system leading into the header. The similar cross-sectional area technology incorporated into the microtube heat exchanger header improves the unwanted large-scale two-phase separation within the header, i.e., helps to reduce or eliminate the separation of the phases such that the working fluid remains more homogenous, thus driving higher overall efficiency of the microtube heat exchanger.

Systems that typically incorporate heat exchangers, such as, for example, systems in the aerospace industry, are evolving to also incorporate more computer technology and advanced electronics which require substantial additional cooling. As a result, there is a demand for developments in cooling system heat exchanger technology to achieve better efficiency ratings while minimizing weight. In light of the present disclosure, higher efficiency is achievable by minimizing refrigerant phase change in heat exchanger headers while maximizing phase change within the microtubes themselves, resulting in better heat transfer. This is due to more microtubes having liquid flow rather than only vapor, i.e., a more uniform distribution of liquid refrigerant from the header to the microtubes. Additionally, the methods and systems described herein effectively eliminate the need for a mixing device, thus heat efficiency demands are achieved without an increase in weight or induced pressure drop from a mixing orifice.

In one embodiment, the geometry incorporates internal tubes, channels, or passageways in the microtube heat exchanger headers in order to maintain the same cross-sectional area of the inlet throughout the entire flow path of several back and forth passes to the outlet. The internal tubes further provide a gentle U-turn between consecutive passes through the multi-pass microtube heat exchanger to minimize detrimental pressure losses. Major pressure losses, due to expansion or tortuous flow paths, contribute to phase separation of the working fluid and ultimately add to heat exchanger inefficiencies. The gentle transition of the U-turns also helps minimize any sudden expansion or contraction of the two-phase refrigerant for each pass.

Other embodiments incorporate geometric variations to obtain the gentle U-turn. For example, one embodiment could be adapted to fit as an insert into a header and uses the internal passageways to obtain the gentle U-turn. Another similar embodiment could be adapted to fit as a header onto the heat exchanger; however, it integrates the insert into the header form.

In another embodiment, a header endcap insert is adapted to fit inside the heat exchanger header at both the inlet side and outlet side. This embodiment incorporates particular concave geometries to achieve the gentle U-turn. Although, the concavity may not be as efficient as the internal passageways, the functionality of the gentle U-turn geometry is maintained.

BRIEF DESCRIPTIONS OF THE DRAWINGS

DETAILED DESCRIPTION OF PREFERRED EMBODIMENTS

The following descriptions relate to presently preferred embodiments and are not to be construed as describing limits to the invention, whereas the broader scope of the invention should instead be considered with reference to the claims, which may be now appended or may later be added or amended in this or related applications. Unless indicated otherwise, it is to be understood that terms used in these descriptions generally have the same meanings as those that would be understood by persons of ordinary skill in the art. It should also be understood that terms used are generally intended to have the ordinary meanings that would be understood within the context of the related art, and they generally should not be restricted to formal or ideal definitions, conceptually encompassing equivalents, unless and only to the extent that a particular context clearly requires otherwise.

For purposes of these descriptions, a few wording simplifications should also be understood as universal, except to the extent otherwise clarified in a particular context either in the specification or in particular claims. The use of the term "or" should be understood as referring to alternatives, although it is generally used to mean "and/or" unless explicitly indicated to refer to alternatives only, or unless the alternatives are inherently mutually exclusive. When referencing values, the term "about" may be used to indicate an approximate value, generally one that could be read as being that value plus or minus half of the value. "A" or "an" and the like may mean one or more, unless clearly indicated otherwise. Such "one or more" meanings are most especially intended when references are made in conjunction with open-ended words such as "having," "comprising" or "including." Likewise, "another" object may mean at least a second object or more.

The following descriptions relate principally to preferred embodiments while a few alternative embodiments may also be referenced on occasion, although it should be understood that many other alternative embodiments would also fall within the scope of the invention. It should be appreciated by those of ordinary skill in the art that the techniques disclosed in these examples are thought to represent techniques that function well in the practice of various embodiments, and thus can be considered to constitute preferred modes for their practice. However, in light of the present disclosure, those of ordinary skill in the art should also appreciate that many changes can be made relative to the disclosed embodiments while still obtaining a comparable function or result without departing from the spirit and scope of the invention.

Figure 1:
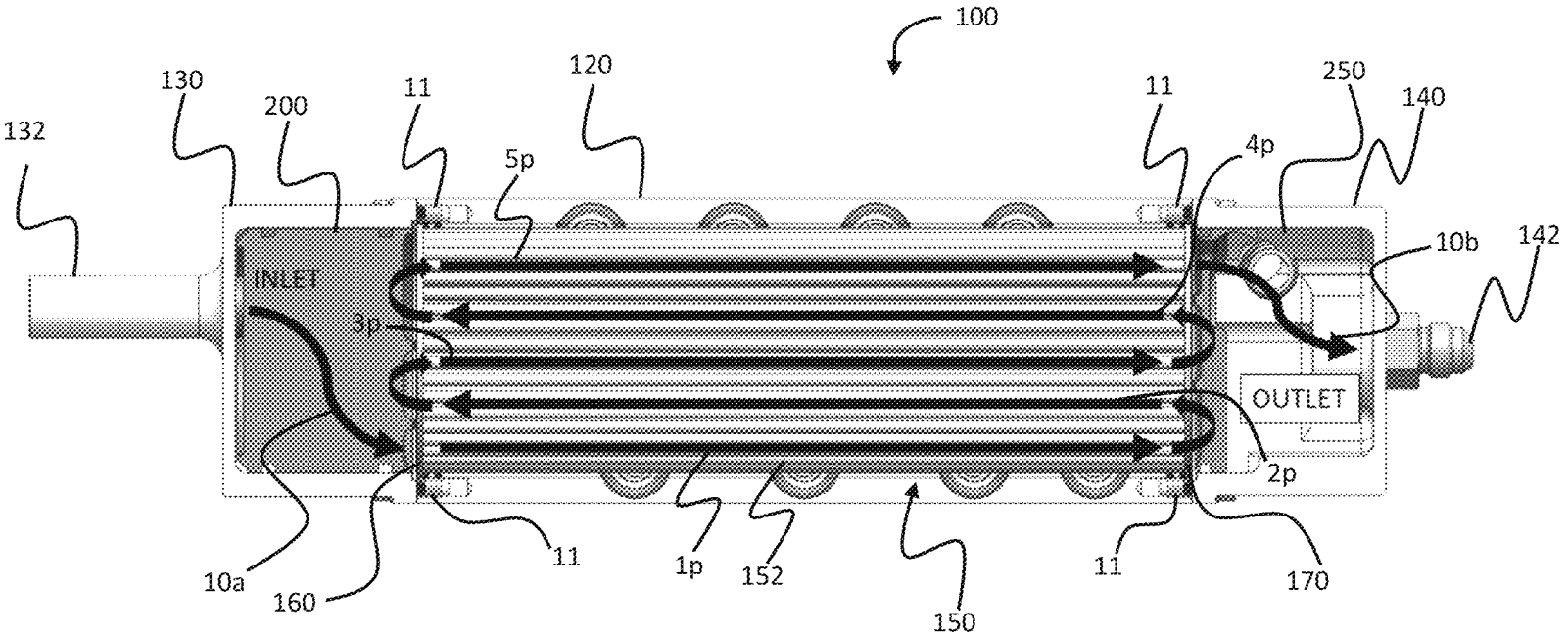
FIG. 1 illustrates a microtube heat exchanger according to an embodiment of this disclosure with a representation of the working fluid flow path also illustrated.

FIG. 1 illustrates a heat exchanger 100 of the present disclosure. The intended flow path of the working fluid cooled or heated by the heat exchanger is illustrated traveling into and out of the heat exchanger 100 with arrows 10*a*, 10*b*. The working fluid, which is also referred to herein as the refrigerant fluid, can be any suitable fluid used for heat exchange purposes, such as a refrigerant, water, or gasses. In preferred embodiments of the present disclosure, the working fluid is R134a refrigerant; however, those of skill in the art will appreciate that other refrigerant types with similar properties could also be used. Heat exchanger 100 is shown with refrigerant fluid flow arrows 1*p*, 2*p*, 3*p*, 4*p*, 5*p* illustrating multiple passes of the refrigerant fluid through heat exchanger tube stack assembly 150. Accordingly, as will be discussed in greater detail below, headers 200, 250 enable heat exchanger 100 to be classified as a multi-pass heat exchanger.

Heat exchanger tube stack assembly 150 contains a plurality of microtubes 152. In some embodiments, the tube stack assembly 150 may incorporate dozens, hundreds, or even thousands of the microtubes 152. An external fluid flows past an outer surface of the plurality of microtubes 152 ("shell-side") to cool or heat the refrigerant fluid flowing internally through the plurality of microtubes 152 ("tube-side"). In liquid-cooled heat exchangers, the external fluid is a liquid, such as for example water or a coolant in some embodiments. In gas-cooled heat exchangers, the external fluid is a gas, such as for example air in some embodiments. Microtubes 152 each have an inner diameter (ID) that are measurable on a micrometer scale. For examples, in some preferred, each microtubes 152 has an ID of substantially 0.018 inch, and outer diameter (OD) 0.02-0.1 inch, and a wall thickness of 0.0017-0.01 inch. Those with skill in the art will understand that microtubes 152 can have IDs, ODs, and wall thicknesses less or greater than what has been described without departing from the scope of this disclosure. As previously discussed, in some embodiments of the disclosure, there are several thousand of microtubes 152 in tube stack 150. For example, in one embodiment, the tube stack 150 has 6,700 microtubes 152. In some embodiments, there are 700-1,100 tubes 152 per square inch of end plate 160, 170. Each tube 152 can be made from any of a number of commonly used methods, such as by being rolled and seam-welded or extruded. In some embodiments, tubes 152 are made from stainless steel alloys, such as 304 stainless steel or 316 stainless steel, for example. However, microtubes can be made from any of a number of materials, such as, for example, super alloys (such as Inconel), titanium, or aluminum.

Each end of each of the plurality of microtubes 152 is coupled with a tube stack end plate 160, 170. The ends of each microtube 152 can be coupled to the respective end plate 160, 170 by any of a number of coupling methods, such as brazing, welding, or bonding.

Figure 2A:
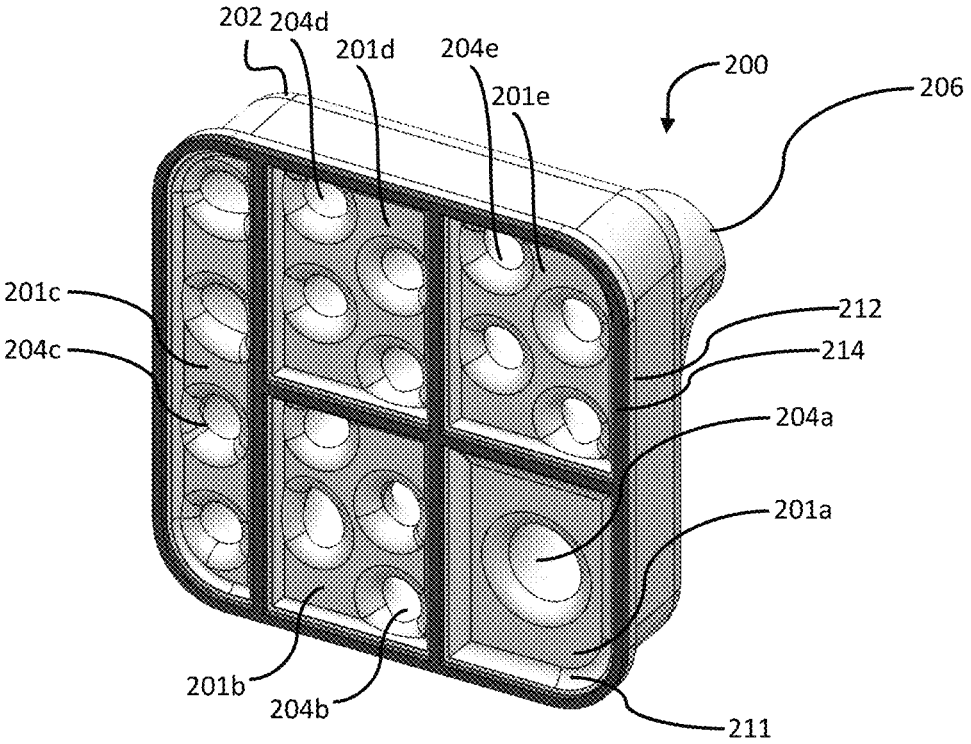
FIG. 2A illustrates a front perspective view of an inlet header insert of the microtube heat exchanger of FIG. 1.
Figure 2B:
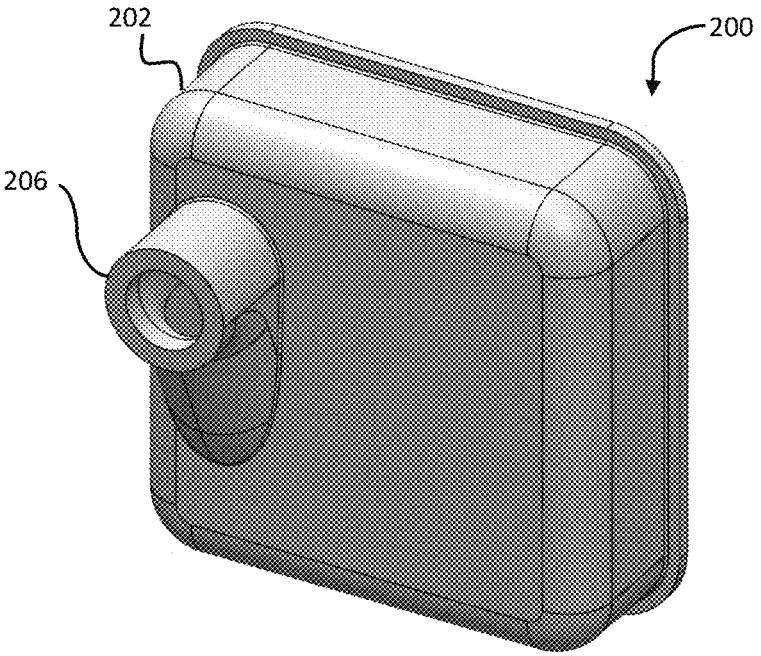
FIG. 2B illustrates a rear perspective view of the inlet header of FIG. 2A.
Figure 3:
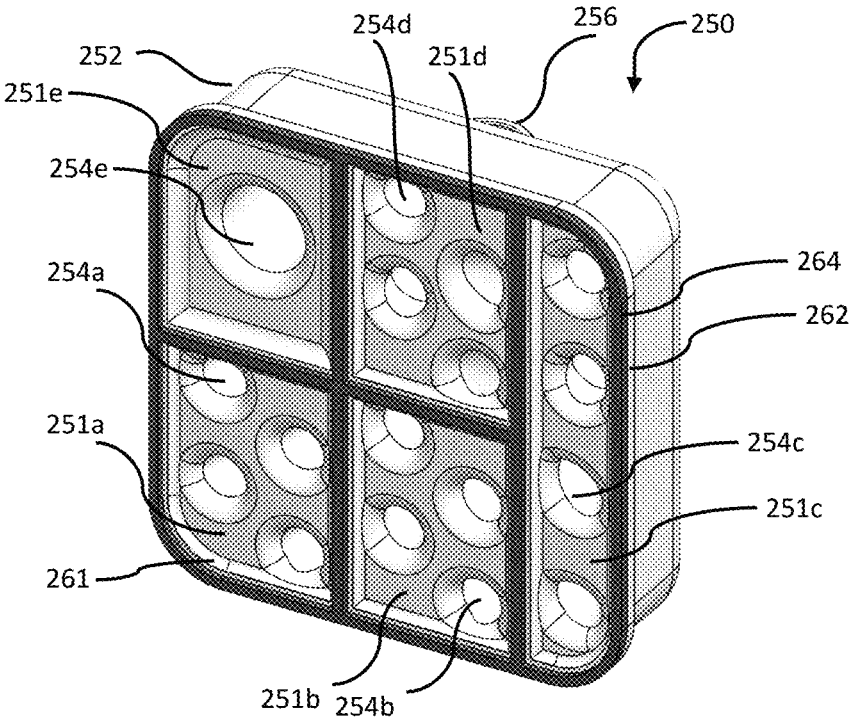
FIG. 3 illustrates a front perspective view of an outlet header insert of the microtube heat exchanger of FIG. 1.

Disposed adjacent to an outer surface of the end plates 160, 170 are header inserts 200 and 250, illustrated in FIGS. 2A, 2B and 3. Header 200 is an inlet side header and header 250 is an outlet side header. The header insert 200 is disposed within heat exchanger inlet housing 130, and header insert 250 is disposed within heat exchanger outlet housing 140. Housings 130, 140 and secured to a heat exchanger main body 120 with fasteners 11, such as screws, which seals headers 200, 250 against their respective tub stack end plates, 160, 170. In some embodiments, header inserts 200, 250 are panels that fit within their respective housing 130, 140. Headers 200, 250 are referred to as inserts because they are separate from their respective housings 130, 140 are removably coupled with the housing 130, 140. For liquid heat exchangers, the headers are assembled into a housing unit that encloses the heat exchanger. For air heat exchangers, the headers are fastened directly to the heat exchanger. It should be noted that other similar fastening methods can be used, however, any fastening method associated with heat exchangers or pressure vessels are candidates for the applications of the present disclosure.

Inlet header 200 has a header body 202 and an inner-facing surface 201 configured to face the adjacent end plate 160 and the tube stack 150. Surface 201 is segregated into a plurality of separate surfaces 201*a*-201*e* by gasket 214. Gasket 214 is disposed on the perimeter of the surfaces to prevent intermingling or cross-contamination of the various refrigerant fluid passes 1*p*-5*p*, as will become evident when the flow path is discussed in greater detail below. Gasket 214 is disposed in a gasket groove 212 of header body 202, which projects outward from surfaces 201*a*-201*e* on raised edge 211 toward the end plate 160 to sufficiently segregate the surfaces. Gasket 214 seals against end plate 160 and thus defines the passes 1*p*-5*p* previously discussed and which of some of the plurality of microtubes 152 are included in each pass 1*p*-5*p*. Gasket 214 is made from a rubber or elastomeric material. Gasket 214 is preferably constructed of an elastomeric material, rubber, or other materials that is compatible with the working fluid. A material being described as compatible means that the material's properties are not compromised upon contact with the working fluid. Non-compatible materials may swell or deteriorate while continuously exposed to the working fluid. For the purposes of describing the current disclosure, the header insert 200 and gasket 214 material are both compatible with common refrigerants, such as R134a. In various embodiments of this disclosure, gasket 214 is made from a nitrile rubber, such as for example Buna-N or an M-Class rubber, such as for example ethylene propylene diene monomer (EPDM) rubber. Those of skill in the art will appreciate that the various types of compatible material or working fluids described herein may be used depending on the application of the present disclosure.

Each surface 201*a*-201*e* also includes at least one associated port 204*a*-204*e*. As illustrated, each surface 201*b*, 201*c*, 201*de*, 201*e* includes four ports 204*b*, 204*c*, 204*d*, 204*e*, and surface 201*a* includes one port 204*a*. As will be discussed in greater detail below, various ports 204*a*-204*e* are strategically interconnected within an interior of header body 202 to allow refrigerant fluid to be transferred between ports 204*a*-204*e*. As illustrated, curved surfaces provide for smooth transition between surfaces 201*a*-201*e* and the associated ports 204*a*-204*e*. The smooth transitions allow for gentler and less turbulent fluid flow between ports 204*a*-204*e* and tube stack 150, as will be discussed in greater detail below, which in turn reduces the pressure drop of the fluid flow and reduces the chance of a phase change occurring within header 200.

Header 250 has features analogous to those of header 200. Specifically, header 250 is header 200 rotated at 180 degrees. Outlet header 250 has a header body 252 and an inner-facing surface 251 configured to face the adjacent end plate 170 and the tube stack 150. Surface 251 is segregated into a plurality of separate surfaces 251*a*-251*e* by gasket 264. Gasket 264 is disposed in a gasket groove 262 of header body 252, which projects outward from surfaces 251*a*-251*e* on raised edge 261 towards end plate 170 to sufficiently segregate the surfaces. Gasket 264 seals against end plate 170 and thus defines the passes 1*p*-5*p* previously discussed and thus which of the plurality of microtubes 152 are included in each pass 1*p*-5*p*. Gasket 264 is substantially the same as gasket 214 previously discussed and can be made from the same materials as gasket 214. Each surface 201*a*-201*e* also includes at least one associated port 254*a*-254*e*. As will be discussed in greater detail below, various ports 254*a*-254*e* are strategically interconnected within an interior of header body 252 to allow refrigerant fluid to be transferred between ports 204*a*-204*e*. Outlet port 256 is configured to be coupled with outlet port 142 of outlet housing 140 and is substantially the same as inlet header 206 previously described.

Referencing FIGS. 1-3, the flow path of refrigerant fluid traveling through heat exchanger 100 can be understood and will be described below. The refrigerant fluid enters heat exchanger 100 at an inlet port 206 of inlet header 200 which is coupled with an inlet port of 132 of housing 130. Inlet port 206 is fluidly coupled with port 204*a*, as will be shown in detail below, and refrigerant fluid is transferred to port 204*a*. The refrigerant fluid is then expelled from port 204*a* toward the tube stack 150. The fluid exiting port 204*a* enters a first group of microtubes 152*a* of the microtubes 152. The first group of microtubes 152*a* are microtubes that have ends fluidly coupled with surfaces 201*a* and 251*a* due to gaskets 214 and 264 being sealed against end plates 160, 170. The fluid then travels through microtubes 152*a* (along path 1*p*) and is discharged against surface 251*a*, where the fluid is received by ports 254*a*. As will be described in greater detail below, ports 254*a* are interconnected with ports 254*b*, and the fluid is transferred from ports 254*a* to ports 254*b*. The refrigerant fluid is then expelled from ports 254*b* toward the tube stack 150. The fluid exiting port 254*b* enters a second group of microtubes 152*b* of the microtubes 152. The second group of microtubes 152*b* are microtubes that have ends fluidly coupled with surfaces 201*b* and 251*b* due to gaskets 214 and 264 being sealed against end plates 160, 170. The fluid then travels through microtubes 152*b* (along path 2*p*) and is discharged against surface 201*b*, where the fluid is received by ports 204*b*. As will be described in greater detail below, ports 204*b* are interconnected with ports 204*c*, and the fluid is transferred from ports 204*b* to ports 204*c*. The refrigerant fluid is then expelled from ports 204*c* toward the tube stack 150. The fluid exiting port 204*c* enters a third group of microtubes 152*c* of the microtubes 152. The third group of microtubes 152*c* are microtubes that have ends fluidly coupled with surfaces 201*c* and 251*c* due to gaskets 214 and 264 being sealed against end plates 160, 170. The fluid then travels through microtubes 152*c* (along path 3*p*) and is discharged against surface 251*c*, where the fluid is received by ports 254*c*. As will be described in greater detail below, ports 254*c* are interconnected with ports 254*d*, and the fluid is transferred from ports 254*c* to ports 254*d*. The refrigerant fluid is then expelled from ports 254*d* toward the tube stack 150. The fluid exiting port 254*d* enters a fourth group of microtubes 152*d* of the microtubes 152. The fourth group of microtubes 152*d* are microtubes that have ends fluidly coupled with surfaces 201*d* and 251*d* due to gaskets 214 and 264 being sealed against end plates 160, 170. The fluid then travels through microtubes 152*d* (along path 4*p*) and is discharged against surface 201*d*, where the fluid is received by ports 204*d*. As will be described in greater detail below, ports 204*d* are interconnected with ports 204*e*, and the fluid is transferred from ports 204*d* to ports 204*e*. The refrigerant fluid is then expelled from ports 204*e* toward the tube stack 150. The fluid exiting ports 204*e* enters a fifth group of microtubes 152*e* of the microtubes 152. The fifth group of microtubes 152*e* are microtubes that have ends fluidly coupled with surfaces 201*e* and 251*e* due to gaskets 214 and 264 being sealed against end plates 160, 170. The fluid then travels through microtubes 152*e* (along path 5*p*) and is discharged against surface 251*e*, where the fluid is received by port 254*e*. Port 254*e* is fluidly coupled with an outlet port 256 of header 250, and the fluid is expelled from heat exchanger 100 via outlet port 256 to an outlet port 142 of outlet housing 140.

Figure 4:
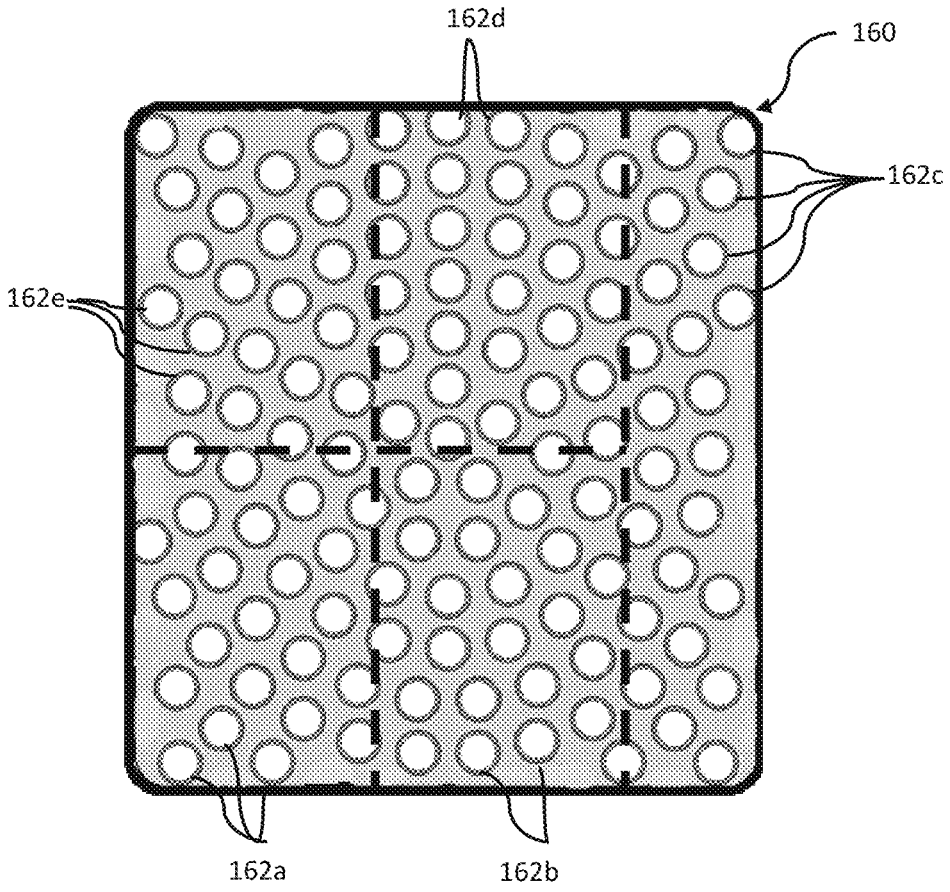
FIG. 4 illustrates a view of tube stack end cap of the microtube heat exchanger of FIG. 1.

FIG. 4 illustrates the surface of end plate 160 that gasket 214 seals against. End plate has a plurality of holes 162, each hole aligned with one of the plurality of microtubes 152 so that refrigerant fluid can pass between the header 200 and the 152 via the holes 162. The dashed lines illustrate where gasket 214 seals against end plate 160, in addition to seal around the outer edge of end plate 160. From this view, it can be understood how the gasket 214 segregates the microtubes 152 into the separate groups of microtube 152*a*-152*e*. Each hole 162*a* is coupled with a microtube 152*a* of the first group of microtubes. Each hole 162*b* is coupled with a microtube 152*b* of the second group of microtubes. Each hole 162*c* is coupled with a microtube 152*c* of the third group of microtubes. Each hole 162*d* is coupled with a microtube 152*d* of the fourth group of microtubes. Each hole 162*e* is coupled with a microtube 152*e* of the fifth group of microtubes. As previously discussed, the microtubes 152 can be coupled with holes 162 of end plate 160 by any of a number of coupling methods, such as brazing, welding, or bonding.

Those with skill in the art will understand that end plate 160 is merely one or various embodiment of the present disclosure. In other embodiments, the end plate 160 can have smaller and more densely concentrated holes 162 to accommodate a tube stack 150 with microtubes 162 of a smaller diameter. As previously discussed, in some embodiments of this disclosure, the tube stack 150 has hundreds or even thousands of microtubes 152, and those with skill in the art will understand that end plate 160 and end plate holes 162 would be fabricated to accommodate the associated tube stack 150. Those within skill in the art will understand that end plate 170 is substantially the same as end plate 160 previously described. As illustrated, gasket 214 partially covers some of the holes 162. However, any efficiency loss due to some of the holes 162 being covered is far outweighed by the multi-pass arrangement performance of heat exchanger 100.

Figure 5:
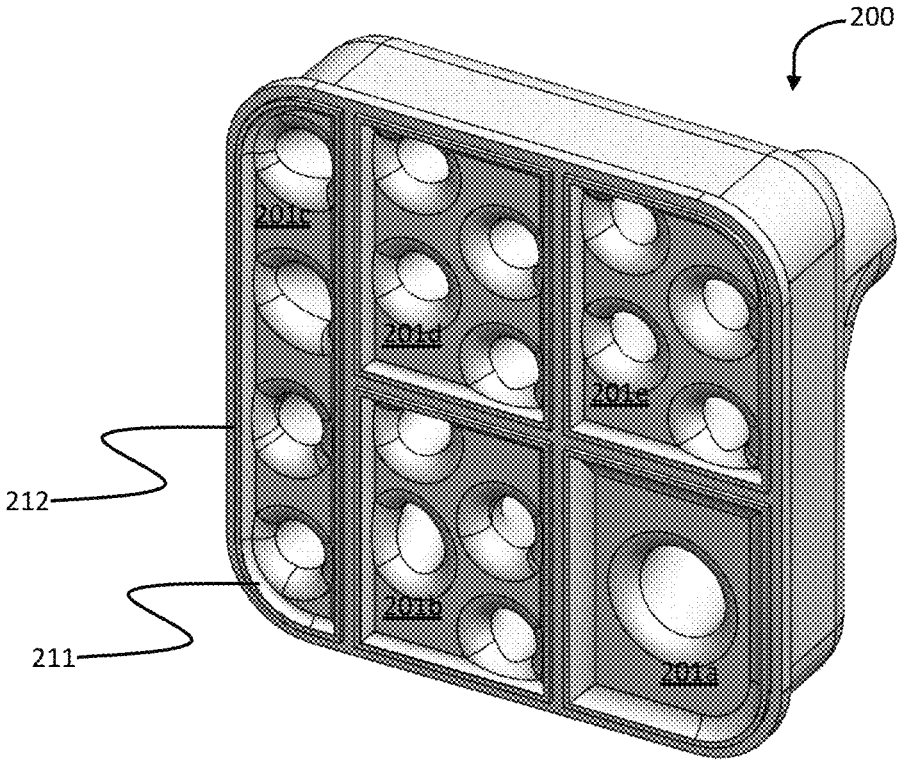
FIG. 5 illustrates a perspective view of the inlet header of FIG. 2 with the gasket removed.

FIG. 5 illustrates a perspective view of header 200 with gasket 214 removed to expose gasket groove 212. Those with skill in the art will understand that header 250 and gasket groove 262 are substantially the same as header 200 and gasket 212 illustrated.

Figure 6:
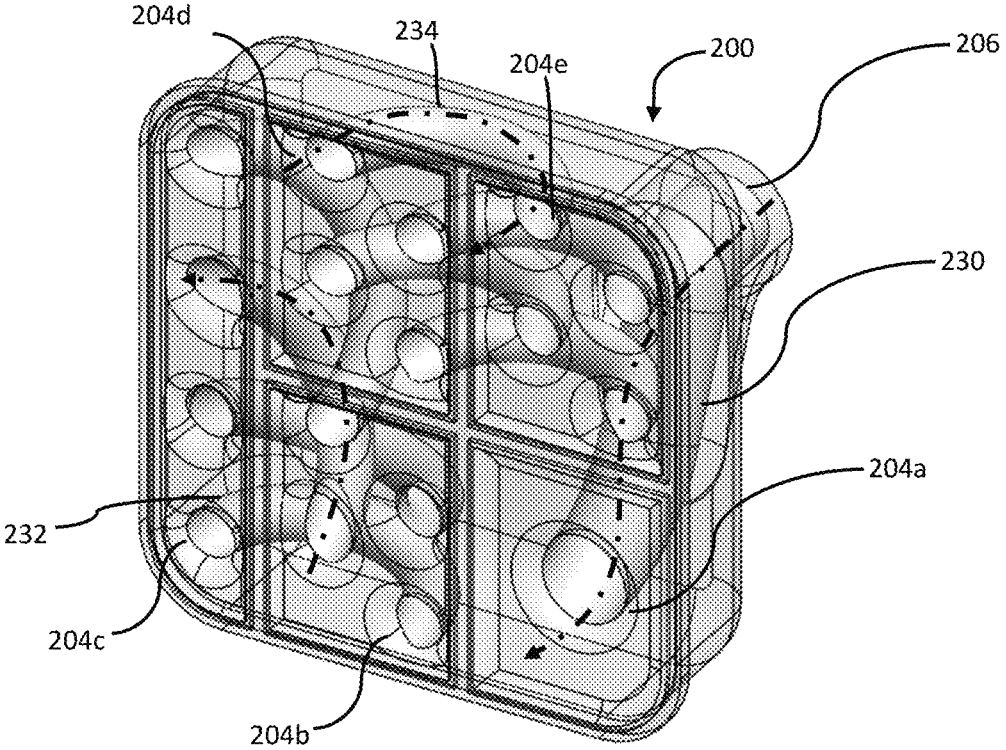
FIG. 6 illustrates a perspective view of the inlet header of FIG. 2 in which the header body is transparent to illustrates internal flow channels of the inlet header.

FIG. 6 illustrates a perspective view of header 200, wherein the internal flow passages or channels of header 200 can be observed. Passage 230 fluidly couples inlet port 206 and port 204*a*. There are four passages 232, each passage 232 fluidly coupling one of the ports 204*b* with one of the ports 204*c*. There are four passages 234, each of the passages 234 fluidly coupling one of the ports 204*d* with one of the ports 204*e*. The flow direction of the working fluid while in selected passage conduits is represented by dashed arrows. Even though dashed arrows are used in the present disclosure to represent flow in a select few flow passage conduits, it should be evident to those of skill in the art that each dashed arrow also represents the flow direction of all flow passage conduits, in accordance with the flow path previously described. The flow passage conduits 230, 232, 234 are also referred to herein as flow channels.

Despite slight differences in the geometry of the individual flow passages 230, 232, 234, the cross-sectional area of each flow passage 230, 232, 234 remains substantially constant. A constant cross-sectional area maintains a constant volume per unit length of the flow passage 230, 232, 234. Those of ordinary skill in the art will know how cross-sectional area affects the overall volume per unit length. The consistent cross-sectional area of the flow passages 232, 234 further contributes to minimizing pressure losses. Additionally, in some embodiments, each of the length of each of the four channels 232 is substantially equal to each other, and the length of each of the channels 234 is substantially equal to each other, which reduces pressure drop along these U-turns by maintaining a constant volume and reduces the chance of phase-change occurring with the header 200. The flow passage 232, 234 geometry depicted may be referred to as a "gentle U-turn" curve, as it will be hereinafter, however alternative embodiments may use other forms of geometry to achieve a similar result. However, the gentle u-tun depicted is preferred, as gentle geometries, as opposed to abrupt ones, reduce pressure drop along the turn.

Figure 7:
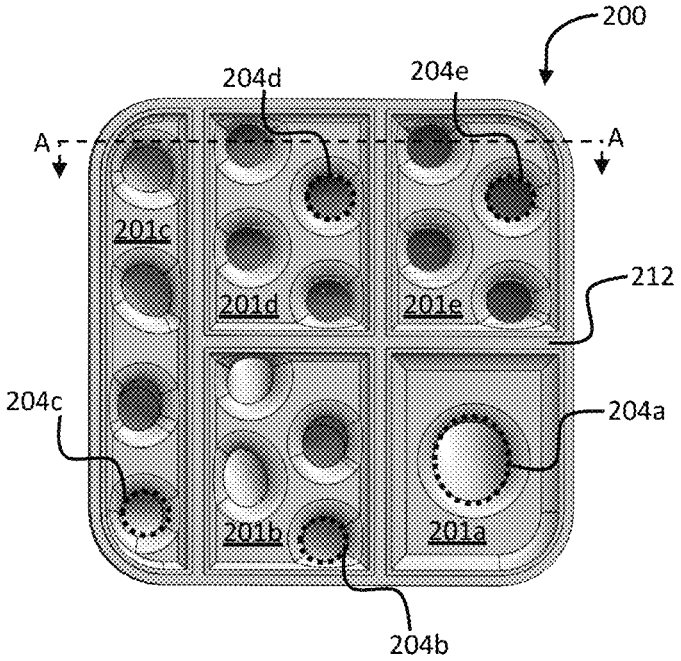
FIG. 7 illustrates a front view of the inlet header of FIG. 2 with the gasket removed.

FIG. 7 illustrates a front view of header 200. In some embodiments, the cross-sectional area of each of ports 204*b* 204*c*, 204*d*, and 204*e* are equal to each other. In some embodiments, the sum of the cross-sectional areas of the four ports 204*b* is equal to the cross-sectional area of port 204*a*. In some embodiments, the sum of the cross-sectional areas of the four ports 204*c* is equal to the cross-sectional area of port 204*a*. In some embodiments, the sum of the cross-sectional areas of the four ports 204*d* is equal to the cross-sectional area of port 204*a*. In some embodiments, the sum of the cross-sectional areas of the four ports 204*e* is equal to the cross-sectional area of port 204*a*. That is to say, in some embodiments, the cross-sectional area of port 204*a* is four times the size of the cross-sectional area of each of ports 204*b*-204*e*. Thus, the cross-sectional flow area defined by the inlet port 204*a* is maintained throughout the flow path of the heat exchanger. By maintaining the same flow path cross-sectional area through the heat exchanger, refrigerant fluid pressure drops are reduced. Alternative embodiments may have more or less ports than what is described in the present disclosure in order to best maintain the cross-sectional area of the flow path throughout the heat exchanger 100.

Those with skill in the art will understand that header 200 can be said to have header fluid passages configured to receive fluid from the tube stack 150 traveling in a first direction and discharge the received fluid back toward the tube stack 150 in a second direction, opposite of the first direction. For example, header 200 can be said to have a header fluid passage comprising surfaces 201*b* and 201*c*, ports 204*b* and 204*c*, and channels 232. The header fluid passage is configured to receive fluid from the tube stack 150 at surface 201*b* and ports 204*b*, and discharge the fluid at surface 201*c* and ports 204*c* via channels 232. Similarly, surfaces 201*d* and 201*e*, ports 204*d* and 204*e*, and channels 234 form another header fluid passage of header 200. Those with skill in the art will understand that header 250 has header fluid passages analogous to those described for header 200. Additionally, inlet header 200 has an inlet passage comprising ports 206, 204*a*, and surface 201*a*, and outlet header 250 has an outlet passage comprising ports 245, 254*e* and surface 251*e*, each of the header passages described also includes gasket 214, 264.

Traditionally, heat exchangers have headers with a large open volume, similar to a reservoir or accumulator. The large open volume allows opportunity for the working fluid to suddenly expand, therefore contributing to a pressure drop and decreased efficiency. With the geometry of the flow passage 232, 234 described, the gentle U-turn shape minimizes or eliminates pressure drops by maintaining a constant cross-sectional area and providing a smooth direction change. Additionally, the U-turn shape is functional to extend the effective length of the tube stack 150 by providing gentle transition between multiple passes. If the working fluid changes direction abruptly, which happens during sudden changes in flow direction, pressure losses may occur. Therefore, sharp angles or 90-degree turns are avoided in the design of the flow passage geometry.

Figure 8:
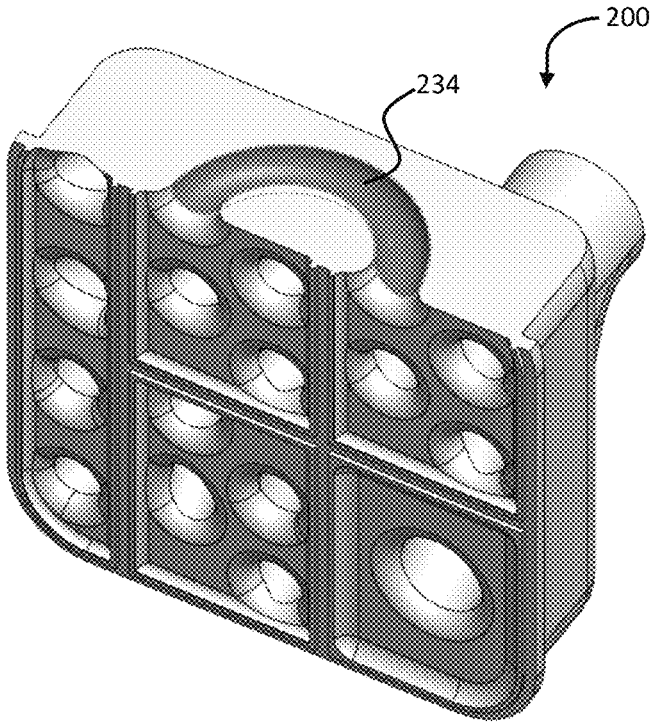
FIG. 8 illustrates a perspective cross-sectional view taken along line A-A of FIG. 7

The view of header insert 200 in FIG. 8 is a partial cross-sectional view at plane A-A shown in FIG. 7 and illustrates the geometry of the working fluid's flow passage 234. Those of ordinary skill in the art will appreciate that several forms of geometry, other than the geometry depicted in FIG. 8, may be used to achieve similar results in applications of the present disclosure.

The header inserts 200, 250 are constructed out of a material that is compatible with the applied working fluid. Since, in some embodiments, the header inserts 200, 250 are not a pressure containing part, they could be constructed out of materials that are not required to meet various industry-specific pressure containing structural requirements, since housings 130, 140 are manufactured to meet the industry-specific requirements. Additionally, the header inserts 200, 250 could be constructed out of experimental materials without compromising the integrity of the structures needed to contain pressure, including side housing units 130, 140. Manufacturing methods such as casting or 3D printing may be used to produce the header inserts 200, 250. Those of ordinary skill in the art will appreciate that other forms of additive manufacturing can also be used to produce the header inserts 200, 250. In some embodiments, header inserts 200, 250 are 3d printed and made of nylon. In some embodiments, header inserts are made of metal.

In some embodiments, header inserts 200, 250, can also be used in retrofit applications to decrease maintenance costs or could be utilized in other applications where separate or interlocking modular panels may be necessary. For example, in some embodiments, heat exchanger 100 is manufactured to be a single-pass microtube heat exchanger. According to some embodiments, header inserts 200, 250 are inserted into housings 130, 140 to change heat exchanger 100 from a single-pass microtube heat exchanger to a multi-pass heat exchanger.

Figure 9:
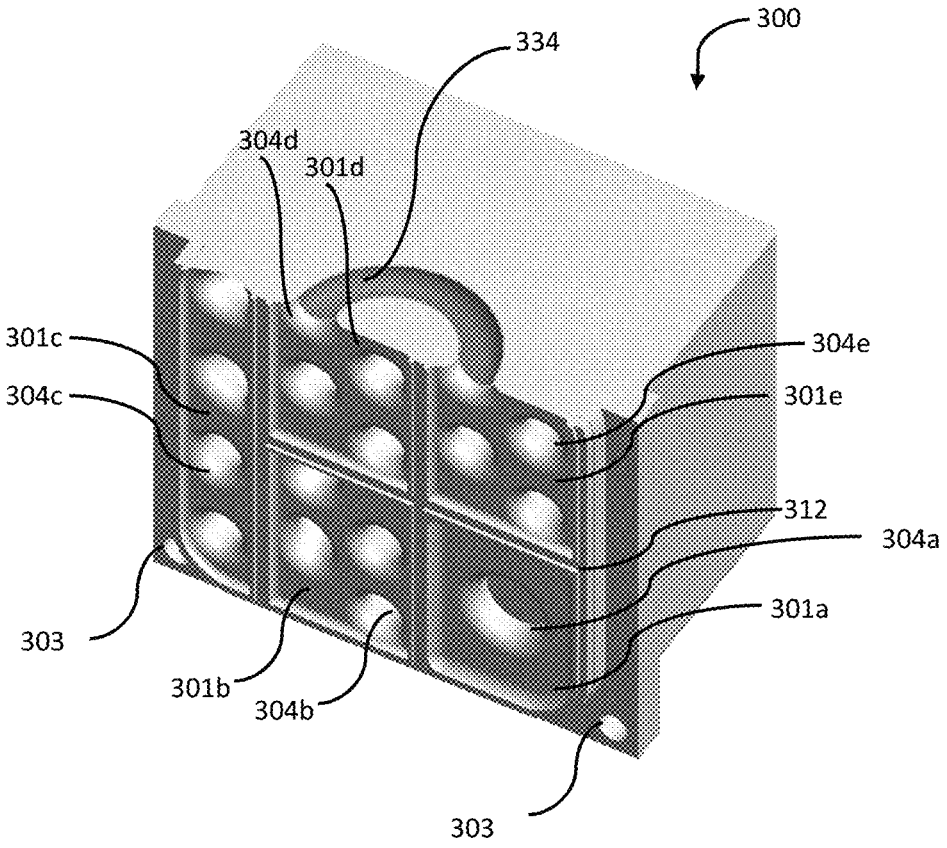
FIG. 9 illustrates a perspective cross-section view of a header.

FIG. 9 illustrates a cutaway view of a header 300 to be used in an alternative embodiments of microtube heat exchangers. Header 300 is substantially the same as header 200 previously described, except header 300 is not an insert that is inserted to a housing 130 such as header 200. Instead, header 300 is considered an integrated header in that it is configured to be coupled directly with a housing 120 of the heat exchanger 100. Header 300 has mounting holes 303, such as bolt holes, so that the header can be attached directly to a heat exchanger body. Header 300 has surface 301*a*-301*e* substantially the same as corresponding surfaces 201*a*-201*e*. Header 303 has ports 304*a*-304*e* substantially the same as corresponding ports 204*a*-204*e*. Header 300 has a gasket groove 312 substantially the same as gasket groove 212 and is configured to accept gasket 214. Header 300 has passages 330-334 substantially the same as corresponding passages 230-234. Header 300 has an inlet port configured to be coupled with a fluid supply line. The header insert 300 is designed to be independent from the housing units and therefore may not have to adhere to the specifications associated with pressure containing parts. The integrated header 300 requires the header insert 200 equivalent section to match the specifications of the side housing units 130, 140. As a result, materials and manufacturing methods may differ without sacrificing functionality.

One with skill in the art will understand that other embodiments of this disclosure include an integrated outlet header substantially the same as header 300 but with inner face, port, and passage configurations corresponding to header 250 previously discussed.

Figure 10:
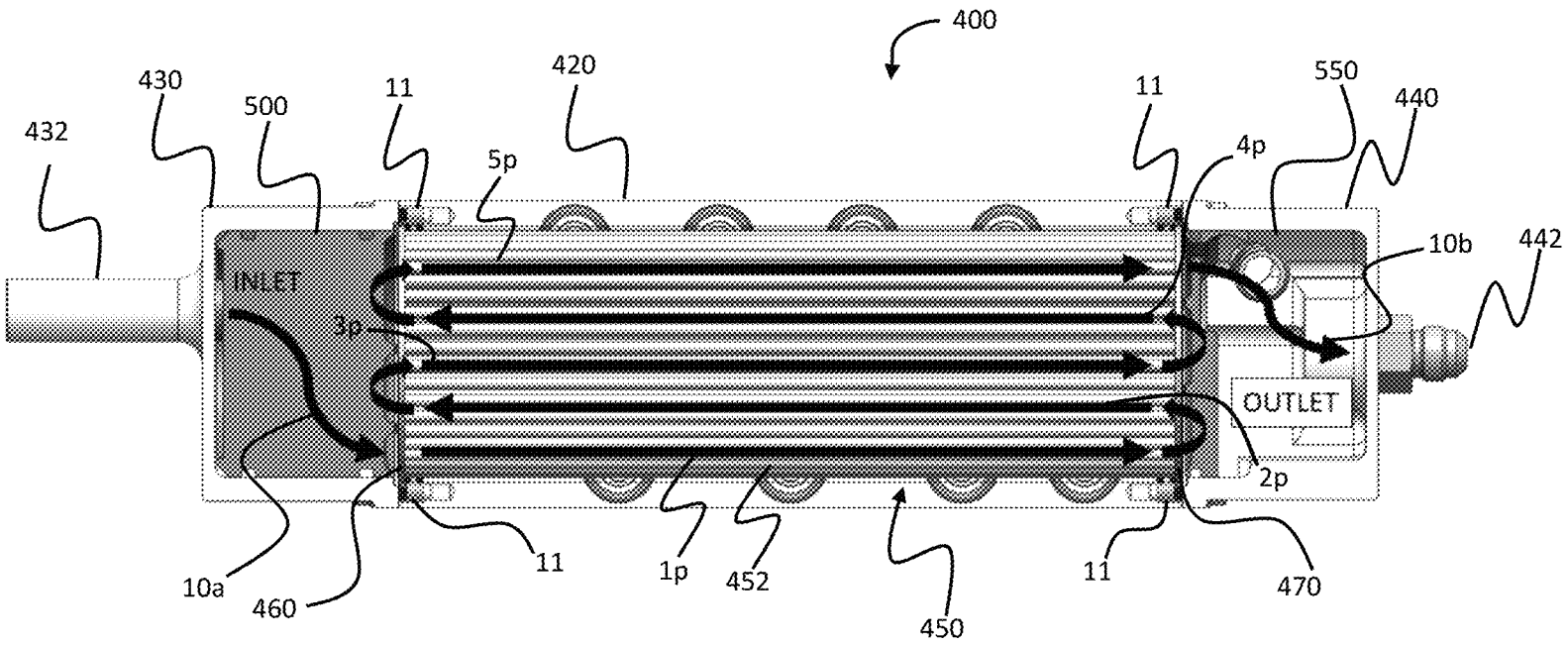
FIG. 10 illustrates a heat exchanger, according to another embodiment of this disclosure.

FIG. 10 illustrates a heat exchanger 400 according to another embodiment of this disclosure. One with skill in the art will understand that heat exchanger 400 is substantially the same as heat exchanger 400 previously described. Heat exchanger 400 comprises an inlet housing 430, an outlet housing 440, and a main body 420 substantially the same as inlet housing 130, an outlet housing 140, and main body 120 previously described. Heat exchanger has a tube stack 450 comprising a plurality of microtubes 452 substantially the same as tube stack 150 and microtubes 152 previously described. Heat exchanger has tube stack end plates 460 and 470 coupled with microtubes 452 substantially the same as end plates 160 and 170 previously described. Heat exchanger 400 has an inlet header 500 and outlet header 550. Similar to inserts headers 200, 250 previously discussed, headers 500, 550 are header inserts that are housed within their respective housings 130, 140.

Figure 11:
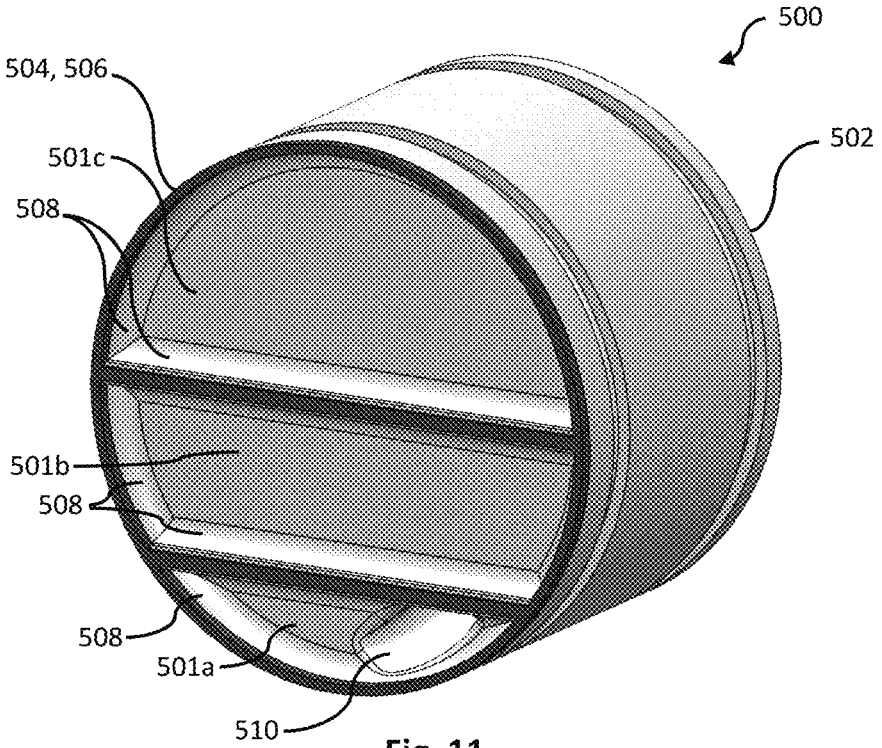
FIG. 11 illustrates a perspective view of an inlet header insert of the heat exchanger of FIG. 10.

FIG. 11 illustrates inlet header 500. Inlet header 500 has a header body 502 and a gasket 504 disposed in a gasket groove 506. Gasket 504 is made from the same material as gasket 214 previously described. Header 500 has an inner facing surface 501 which faces the tube stack 450 when installed in heat exchanger 400. A raised sealing edge 508 extends from inner surface 501 towards the tube stack 450 when installed in the heat exchanger 400, and in which gasket groove 506 is formed. Raised edge 508 segregates surface 501 into three separate surfaces 501*a*, 501*b*, and 501*c*. Surface 501*a* comprises an inlet passage 510 configured to accept refrigerant fluid from a refrigerant fluid return port 432 and discharge the fluid toward the tube stack 450. Inlet passage 510 is substantially the same as inlet port 206 previously described, and is fluidly coupled with port 432.

Figure 12:
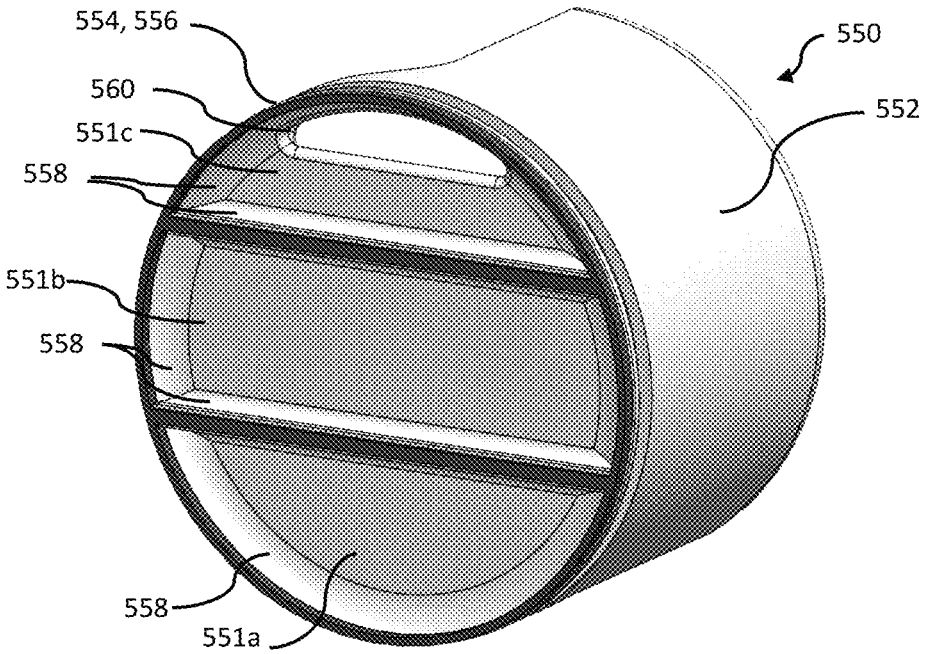
FIG. 12 illustrates a perspective view of an outlet header insert of the heat exchanger of FIG. 10.

FIG. 12 illustrates outlet header 550. Outlet header 550 has a header body 552 and a gasket 554 disposed in a gasket groove 556. Gasket 554 is made from the same material as gasket 214 previously described. Header 550 has an inner facing surface 551 which faces the tube stack 450 when installed in heat exchanger 400. A raised sealing edge 558 extends from inner surface 550 towards the tube stack 450 when installed in the heat exchanger, and in which gasket groove 556 is formed. Raised edge 558 segregates surface 551 into three separate surfaces 551*a*, 551*b*, and 551*c*. Surface 551*a* comprises an outlet port 560 configured to accept refrigerant fluid from the tube stack 450 and discharge the fluid away from the tube stack 450 to refrigerant fluid discharge port 442, outlet passage 560 is substantially the same as outlet port 256 previously described, and is fluidly coupled with port 442.

Figure 13:
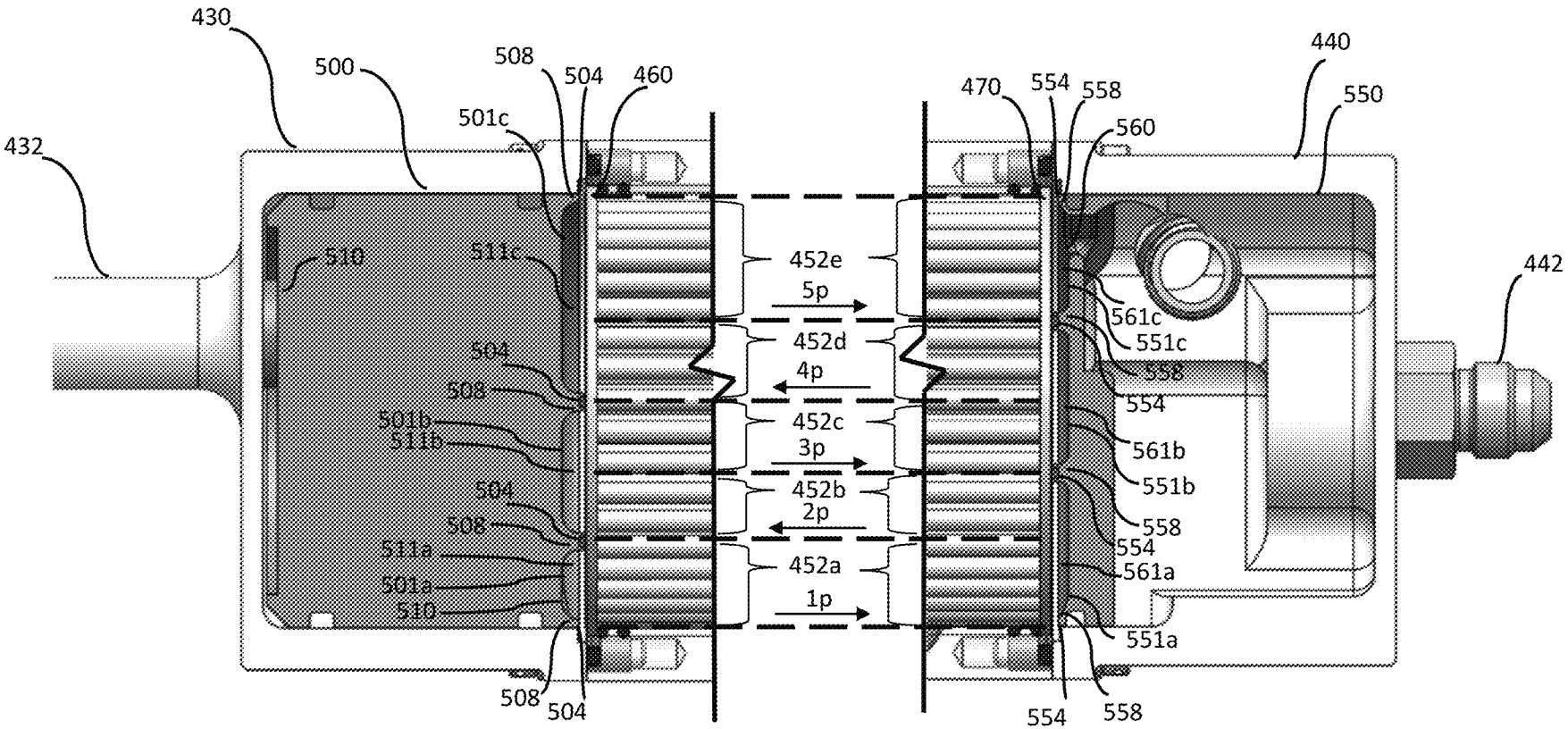
FIG. 13 illustrates enhanced views of the refrigerant inlet and outlet sides of the heat exchanger of FIG. 10.

FIG. 13 illustrates a cutaway view of heat exchanger 400, specifically showing details of the inlet and outlet sides of the heat exchanger 400. As can be seen in FIG. 13, when headers 500, 550 are installed in place and sealed against end plates 460, 470, volumes are formed between by the respective surface 501*a-c*, 551*a-c* and the end plate 460, 470 due to the raised edge 508, 558 being protruded from the surface 501*a-c*, 551*a-c* and sealing against the end plate 460, 470 with gasket 504, 554. Volume 511*a* is formed between surface 501*a* and end plate 460, volume 511*b* is formed between surface 501*b* and end plate 460, and volume 511*c* is formed between surface 501*c* and end plate 460. Similarly, volume 561*a* is formed between surface 561*a* and end plate 470, volume 561*b* is formed between surface 551*b* and end plate 470, and volume 561*c* is formed between surface 551*c* and end plate 470.

Referencing FIGS. 10-13, the flow path of refrigerant fluid traveling through heat exchanger 400 can be further understood. Refrigerant fluid enters heat exchanger 400 and inlet 432 and flows to inlet passage 510 of header 500. Passage 510 extends from a back side of header body 202 of passage to surface 501*a*, and discharges the incoming fluid at surface 501*a*. Volume 511*a* fills with fluid and travels along the first fluid path 1*p* in a first group of microtubes 452*a* of the plurality of microtubes 452 where it is discharged to volume 561*a*. Volume 561*a* fills with fluid and the fluid is the discharged into a second group of microtubes 452*b*. Accordingly, volume 561*a* can be said to act as a "U-turn" segment, as it receives fluid traveling from tubes 452*a* in a first direction, and re-directs the fluid in a second direction (opposite of the first direction) to a second group of tubes 452*b*. The fluid traveling in tubes 452*b* along the second flow path 2*p* is discharged into volume 511*b*, which fills with fluid and discharges the fluid to a third group of microtubes 452*c*. Volume 511*b* can be said to act as a U-turn segment for the same reasons discussed regarding volume 561*a*. The fluid travels in tubes 452*c* along the third flow path 3*p* and is discharged into volume 561*b*, which fills with fluid and discharges fluid to a fourth group of microtubes 452*d*. Volume 516*b* can be said to act as a U-turn segment for the same reasons discussed regarding volume 561*a*. The fluid travels in tubes 452*d* along the fourth flow path 4*p* and is discharged into volume 511*c*, which fills with fluid and discharges fluid to a fifth group of microtubes 452*e*. Volume 511*c* can be said to act as a U-turn segment for the same reasons discussed regarding volume 561*a*. The fluid travels in tubes 452*e* along the fifth flow path 5*p* and is discharged into volume 551*c*. The fluid then is discharged from header 550 via outlet passage 560, which is fluidly coupled with an outlet port 442 of the heat exchanger and thus allows for the refrigerant fluid to be discharged from heat exchanger 400.

Those with skill in the art will understand that header 500 can be said to have header fluid passages configured to receive fluid from the tube stack 450 traveling in a first direction and discharge the received fluid back toward the tube stack 450 in a second direction, opposite of the first direction. For example, header 500 can be said to have a header passage comprising volume 511*b* formed by surface 501*b*, edge 508, and gasket 504 sealed against end plate 460, configured to receive fluid from tubes 452*b* and discharge the received fluid to tubes 452*d*. Similarly, volume 511*c* formed by surface 501*c*, edge 508, and gasket 504 sealed against end plate 460 can be said to be another header fluid passage of header 500. Analogously, for header 550, volume 561*a* formed by surface 551*a*, edge 558, and gasket 554 sealed against end plate 470 can be said to be a header fluid passage; and volume 561*b* formed by surface 561*b*, edge 558, and gasket 554 sealed against end plate 470 can be said to be a header fluid passage. Additionally, inlet header 500 has an inlet passage comprising port 510 and volume 511*a* formed by surface 501*a*, edge 508, and gasket 504 sealed against end plate 460. Additionally, outlet header 500 has an outlet passage formed by port 560 and volume 561*c* formed by surface 551*a*, edge 558, and gasket 554 sealed against end plate 470.

Figure 14:
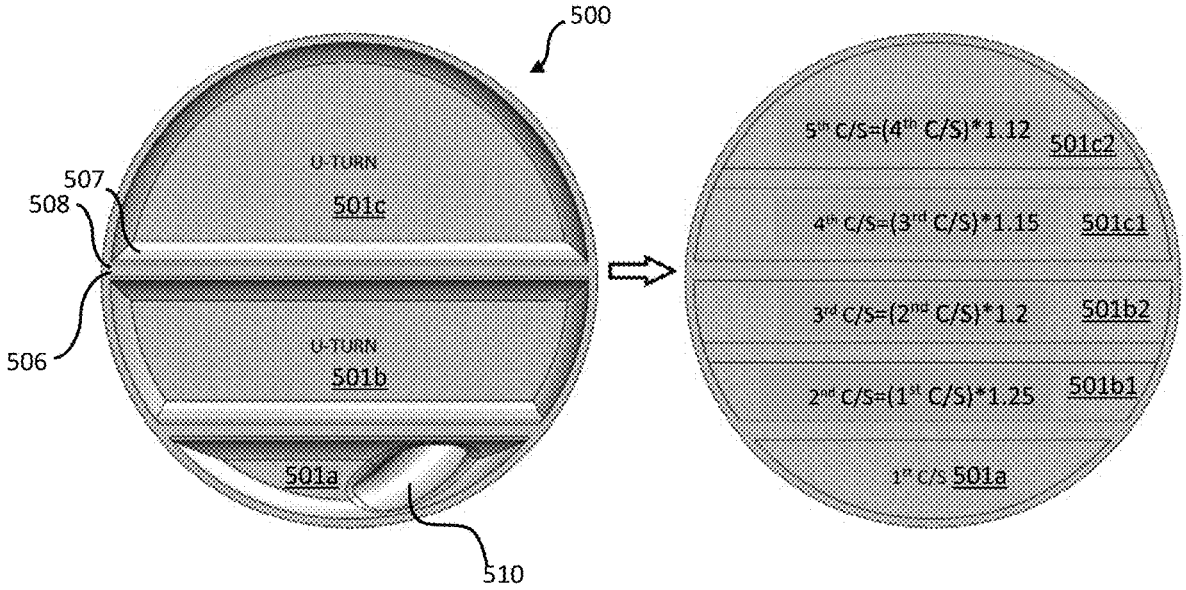
FIG. 14 illustrates a front view of the inlet header of FIG. 11 with the gasket removed and with a corresponding illustration for explaining various surface areas of the inlet header.

FIG. 14 illustrates a front view of header 500 and a corresponding illustration for explaining the surface areas of the surfaces 501*a*-501*c*. As can be seen in FIG. 14, the surface area of surface 501*b*1, which is aligned with and receives refrigerant fluid from tubes 452*b*, is 25% larger than the surface area of surface 501*a*. The surface area of surface 501*b*2, which is aligned with and discharges refrigerant fluid to tubes 452*c*, is 20% larger than surface area of 501*b*1. The surface area of surface 501*c*1, which is aligned with and receives refrigerant fluid to tubes 452*d*, is 15% larger than surface area of 501*b*2. The surface area of surface 501*c*2, which is aligned with and discharges refrigerant fluid to tubes 452*e*, is 12% larger than surface area of 501*c*1. Gasket 504 is removed from the header 500 of FIG. 14, exposing gasket groove 506. Between the raised edge 508 and each surface 501*a*-501*c* is a concave surface 507 that aids in maintaining the gentle U-turn shape of flow that volumes 511*a*-511*c* are configured to produce. The gentle curve of surface 507 reduces the pressure drop of the refrigerant fluid and thus reduces the chance of phase change occurring in volumes 511*a*-511*c*. Due to being configured to change the direction of the refrigerant fluid, as has been described, surfaces 501*b* and 501*c* are referred to herein as U-turn surfaces. Surfaces 501*a*-501*c* are substantially flat and effectively redirect the working fluid with a similar U-turn shaped path.

Figure 15:
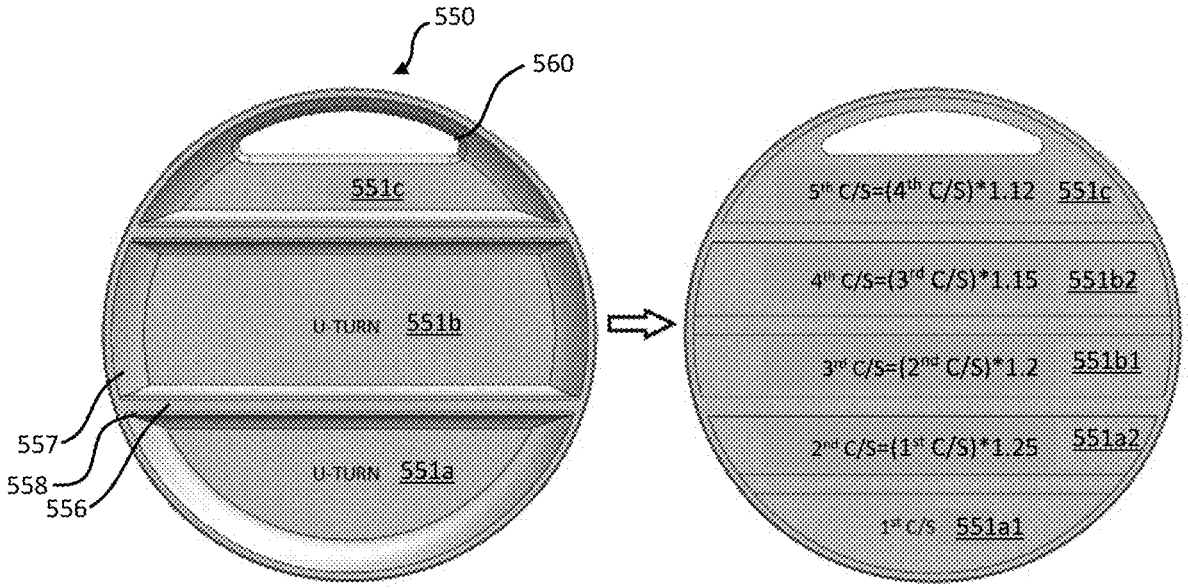
FIG. 15 illustrates a front view of the outlet header of FIG. 12 with the gasket removed and with a corresponding illustration for explaining various surface areas of the outlet header.

FIG. 15 illustrates a front view of header 550 and a corresponding illustration for explaining the surface areas of surfaces 551*a*-551*c*. Surface areas 551*al* is aligned with and receives fluid from tubes 452*a*. The surface area of surface 551*a*2, which is aligned with and discharges fluid to tubes 452*b*, is 25% larger than the surface area of surface 551*a*1. The surface area of surface 551*b*1, which is aligned with and receives fluid from tubes 452*c*, is 20% larger than the surface area of surface 551*a*2. The surface area of surface 551*b*2, which is aligned with and discharges fluid to tubes 452*d*, is 15% larger than the surface area of surface 551*b*1. The surface area of surface 551*c*, which is aligned with and receives fluid to tubes 452*e*, is 12% larger than the surface area of surface 551*b*2. Gasket 504 is removed from the header 550 of FIG. 14, exposing gasket groove 556. Between the raised edge 508 and each surface 501*a*-501*c* is a concave surface 507 that aids in maintaining the gentle U-turn shape of flow that volumes 511*a*-511*c* are configured to produce. Between the raised edge 558 and each surface

551*a*-551*c* is a concave surface 557 that aids in maintaining the gentle U-turn shape of flow that volumes 561*a*-561*c* are configured to produce. The gentle curve of surface 557 reduces the pressure drop of the refrigerant fluid and thus reduces the chance of phase change occurring in volumes 511*a*-511*c*. Due to being configured to change the direction of the refrigerant fluid, as has been described, surfaces 551*a* and 551*b* are referred to herein as U-turn surfaces. Surfaces 551*a*-551*c* are substantially flat and effectively redirect the working fluid with a similar U-turn shaped path.

The header endcap inserts 500, 550 incorporate a variable cross-sectional area. After the first pass, the cross-sectional area of the flow passage expands with respect to the cross-sectional area of the previous pass. In some embodiments, for the first pass, the surface area of 501*a* is equal to the surface area of 551*a*1; for the second pass, the surface area 551*a*2 is equal to the surface are 501*b*1; and so on for the third, fourth, and fifth passes. The amount by which the cross-sectional area changes is dependent on the amount of phase separation estimated at each pass level. Those of skill in the art will appreciate each change in cross-sectional area is done to achieve an increase or decrease in volume at each pass level; this is done to compensate for changes in the amount of working fluid vapor to better match increasing volume of the vapor to the channels it passes through. Depending on the function of the heat exchanger, volumetric expansion may be needed if the heat exchanger's working fluid is being heated. Inversely, a volumetric contraction may be needed if said working fluid is being cooled. In some embodiments, at the fifth pass, the working fluid is predicted to be mostly vapor and would require a larger cross-sectional area to maintain constant pressure at the outlet.

The variable cross-sectional area at each pass level more closely matches the cross-sectional area of the inlet's cross-sectional area. Furthermore, each variation of cross-sectional area can be adapted to match the working fluid's expansion ratio, thereby reducing pressure drops and increasing heat exchanger efficiency. The inventors are contemplating methods for fine-tuning the cross-sectional area difference at each pass. Even though FIG. 14 and FIG. 15 depict an increase in each sequential cross-sectional area, those of ordinary skill in the art will appreciate that alternative embodiments may also incorporate a decrease in cross-sectional areas.

It is important to note that header endcap inserts 500, 550 include geometry at surface 21 that is concave and aids in maintaining the gentle U-turn shape of this embodiment's flow passage.

Figure 16:
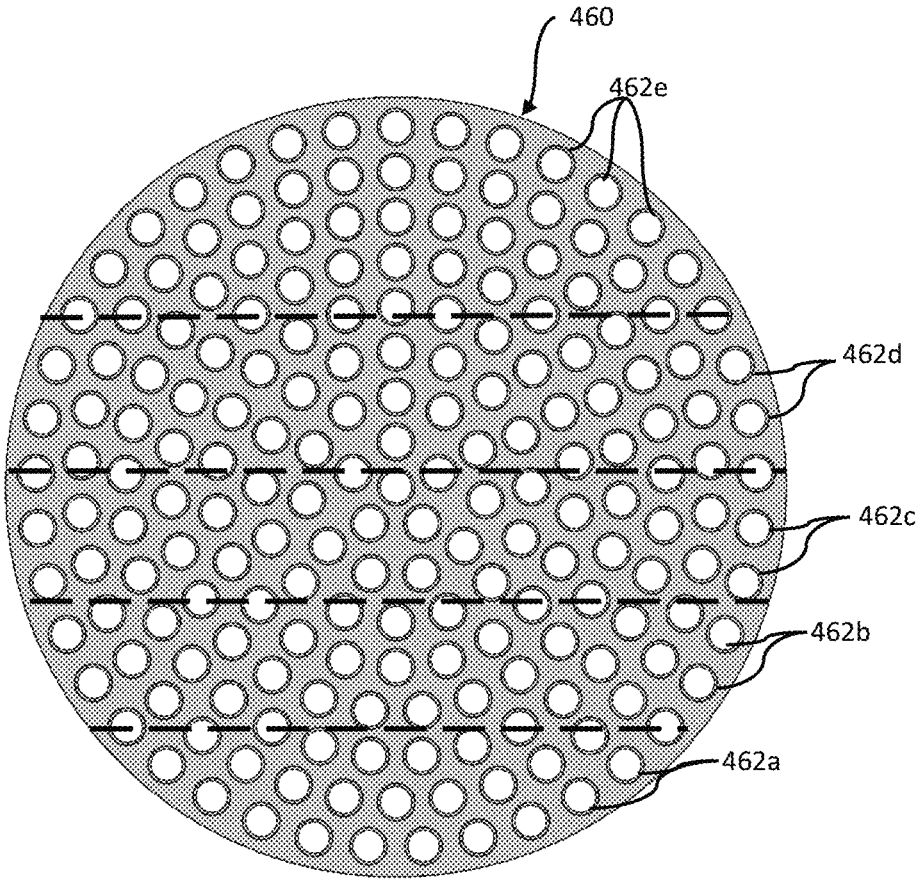
FIG. 16 illustrates a tube stack end plate of the heat exchanger of FIG. 10.

FIG. 16 illustrates a view of end plate 460 with a plurality of tube holes 462, each coupled to an end of one of the plurality of microtubes 452. Microtubes 452 are coupled to end plate 460 as previously described with microtubes 152. The dotted lines illustrate the segregations of the tubes made by gaskets 504, 554 previously discussed to form the flow paths 1*p*-5*p*. Holes 462*e* are coupled with tubes 452*e*, holes 462*d* are coupled with tubes 452*d*, holes 462*c* are coupled with tubes 452*c*, holes 462*b* are coupled with tubes 452*b*, and holes 462*a* are coupled with tubes 452*a*. Those with skill in the art will understand that plate 470 is substantially the same as plate 460.

Figure 17:
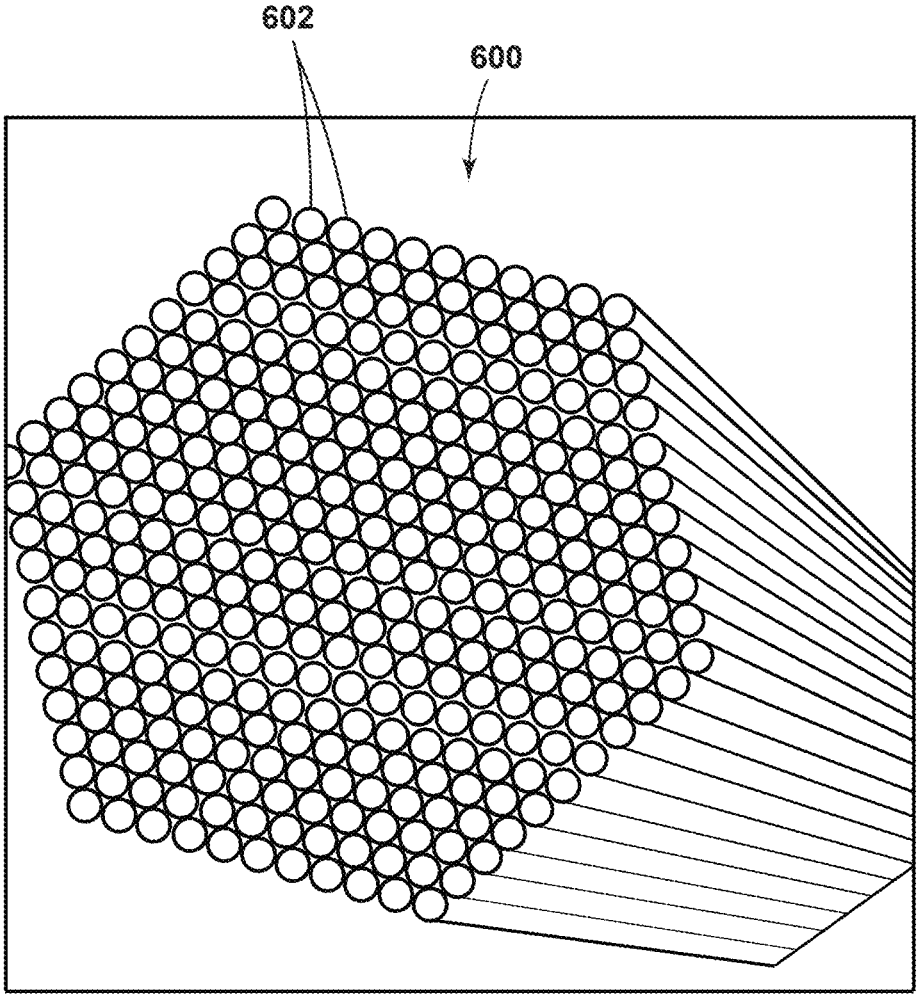
FIG. 17 illustrates a tube stack according to an embodiment of this disclosure.

FIG. 17 illustrates a tube stack 600 according to an embodiment of this disclosure. Tube stack 600 is substantially the same as tube stacks 150, 450 previously described. Tube stack 600 comprises a plurality of microtubes 602, substantially the same as microtubes 152, 452 previously described. Embodiments of this disclosure can incorporate tube stacks formed with cross-sections conforming to any of a number of shapes. As has been described, tube stack 150 has a generally rectangular cross-section, tube stack 450 has a generally circular cross-section, and tube stack 600 has a generally hexagonal cross-section. One with skill in the art will understand that the scope of this disclosure includes tube stacks with cross-sections shaped according to any of a number of possible shapes, made from any suitable material, and fabricated in various ways.

Figure 18:
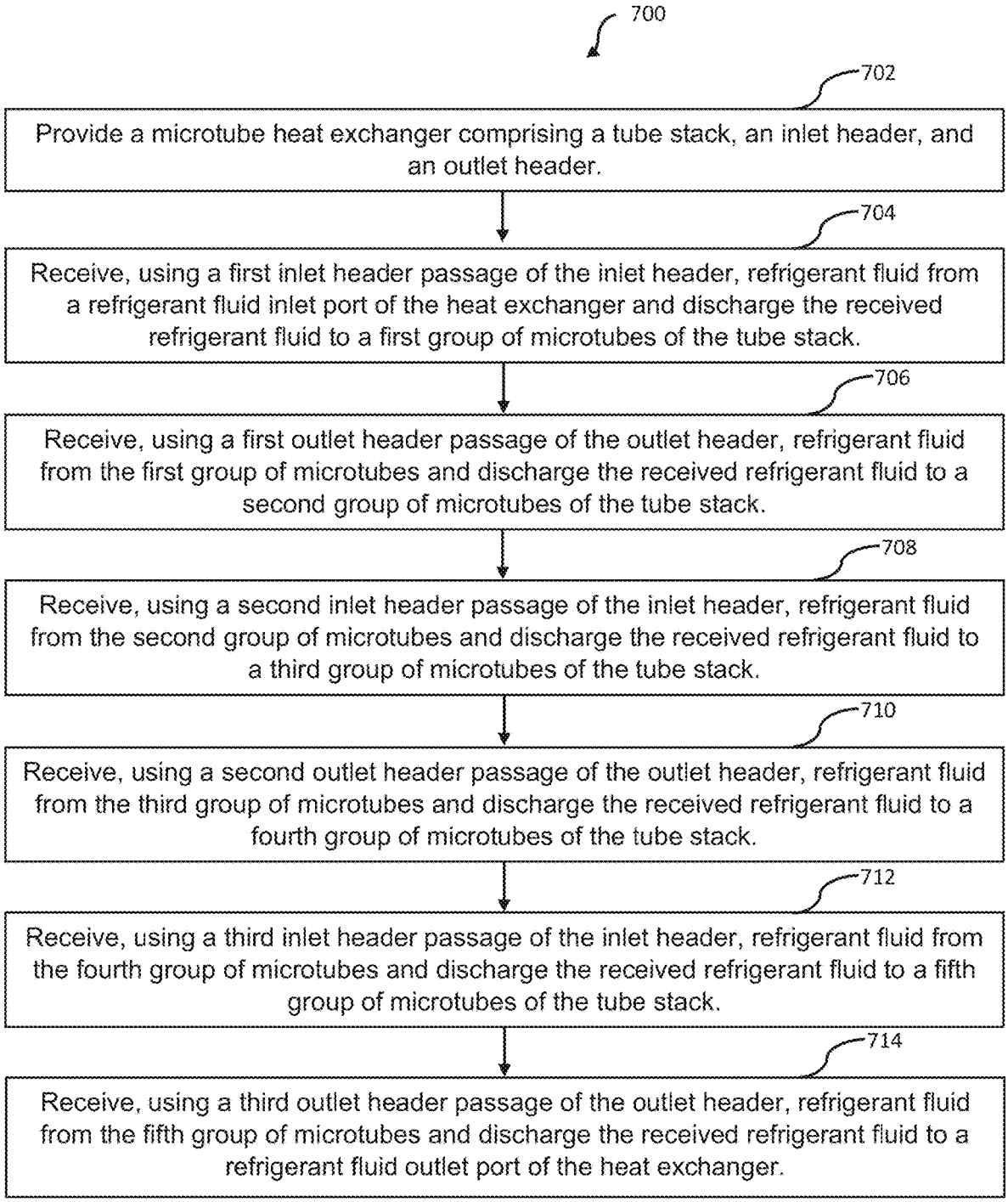
FIG. 18 is a flowchart illustrating a method of circulating a refrigerant fluid through a heat exchanger, according to an embodiment of this disclosure.

FIG. 18 is a flowchart illustrating a method 700 of circulating a refrigerant fluid through a heat exchanger, according to an embodiment of this disclosure. The method can begin at block 702 by providing a heat exchanger comprising headers and a tube stack, such as, for example heat exchanger 100 with headers 200, 250 and tube stack 150 or heat exchanger 400 with headers 500, 550 and tube stack 450. Method 700 can continue at block 704 by receiving, by a first passage of inlet header 200, 500, refrigerant fluid from an inlet 132, 432, of heat exchanger 100, 400 and discharging the received fluid to a first group of microtubes 152*a*, 452*a*. For header 200, the first passage comprises inlet port 206, port 204*a*, channel 230, and surface 201*a*, as has been previously described. For header 500, the first passage comprises inlet port 510 and volume 511*a*, as has been previously described. Method 700 can continue at block 706 by receiving, by a first passage of outlet header 250, 550, refrigerant fluid from the first group of tubes 152*a*, 452*a* and discharging the received fluid to a second group of tubes 152*b*, 452*b*. Method 700 can continue at block 708 by receiving, by a second passage of inlet header 200, 500, refrigerant fluid from the second group of microtubes 152*b*, 452*b* and discharging the received refrigerant fluid to a third group of microtubes 152*c*, 452*c*. Method 700 can continue at block 710 by receiving, by a second passage of the outlet header 250, 550, refrigerant fluid from third group of microtubes 152*c*, 452*c* and discharging the received fluid to a fourth group of microtubes 152*d*, 452*d*. Method 700 can continue at block 712 by receiving, by a third passage of inlet header 200, 500, refrigerant fluid from the fourth group of microtube 152*d*, 452*d* and discharging the received fluid to a fifth group of microtubes 152*e*, 452*e*. Method 700 can continue at block 714 by receiving, by a third passage of outlet header 250, 550, refrigerant fluid from the fifth group of microtubes 152*e*, 452*e* and discharging the received refrigerant fluid to an outlet port 142, 442 of the heat exchanger. Those with skill in the art will understand that method 700 describes a five-pass system, and that steps are added or removed in other embodiments of this disclosure incorporating more or less than five passes.

It is important to note the distinction of the multi-pass heat exchanger systems described herein. A multi-pass system contains several parallel conduits with opposing flow directions, another term that may be used to describe the flow in a multi-pass system is countercurrent flow. Those of ordinary skill in the art know that a single pass system refers to a heat exchanger system where the flow direction of a working fluid does not change. Another term that maybe be used to describe the flow in a single pass system is co-current flow. The heat exchangers associated with the present disclosure are multi-pass systems, which indicates one or more changes in the flow direction of the working fluid. The number of passes is also correlated to the functionality of the heat exchanger unit as a whole. For example, if the heat exchanger unit is to be used as a condenser, in some embodiments, a three-pass system may be desired. If a heat exchanger unit is to be used as an evaporator, in some embodiments, a five-pass system may be desired. With the teachings of the present disclosure, the ability to adapt the heat exchanger's functionality is significantly simplified. Furthermore, header inserts configured for a three-pass system can be replaced with header inserts configured for a five-pass system, and vice versa, all why incorporating a same heat exchanger body and tube stack. Heat exchanger systems 100, 400 are configured for five passes, represented with arrows 1*p*, 2*p*, 3*p*, 4*p*, 5*p*. However, the systems 100, 400 or systems similar to the one shown, can be configured for more or less than five passes. For example, in some alternative embodiments of the present disclosure that adapt systems 100, 400 to perform two to seven passes. Still other embodiments incorporate more than seven passes.

Another benefit for implementing the header inserts 200, 250, 500, 550 is in scenarios where fouling of the heat exchanger 100, 400 may occur. Although it is not typically anticipated with closed systems, there are some instances where debris contaminates the working fluid and may collect and obstruct the flow through the heat exchanger. With the teachings of the present disclosure, maintenance costs associated with the fouling scenario are reduced from ease of disassembly and access for cleaning. In some embodiments, replaceable filters are incorporated with the header inserts 200, 250, 500, 550 so that the headers can be used to filter out unwanted debris.

Those with skill in the art will recognize that various other header configurations are possible as embodiments for this disclosure. As has been discussed herein, it is desirable for the headers to maintain the flow path cross-sectional area of the fluid flowing through the tube stack. Accordingly, in some embodiments, the flow paths in the header are made by bundles of flexible polymer microtubes. In this embodiment, the header could have flexible microtubes connecting various tubes of the tube stack and for facilitating the U-turn flow of the refrigerant fluid.

Although the present invention has been described in terms of the foregoing disclosed embodiments, this description has been provided by way of explanation only and is not intended to be construed as a limitation of the invention. Indeed, even though the foregoing descriptions refer to numerous components and other embodiments that are presently contemplated, those of ordinary skill in the art will recognize many possible alternatives exist that have not been expressly referenced or even suggested here. While the foregoing written descriptions should enable one of ordinary skill in the pertinent arts to make and use what are presently considered the best modes of the invention, those of ordinary skill will also understand and appreciate the existence of numerous variations, combinations, and equivalents of the various aspects of the specific embodiments, methods, and examples referenced herein.

Hence the drawings and detailed descriptions herein should be considered illustrative, not exhaustive. They do not limit the invention to the particular forms and examples disclosed. To the contrary, the invention includes many further modifications, changes, rearrangements, substitutions, alternatives, design choices, and embodiments apparent to those of ordinary skill in the art, without departing from the spirit and scope of this invention.

Accordingly, in all respects, it should be understood that the drawings and detailed descriptions herein are to be regarded in an illustrative rather than a restrictive manner and are not intended to limit the invention to the particular forms and examples disclosed. In any case, all substantially equivalent systems, articles, and methods should be considered within the scope of the invention and, absent express indication otherwise, all structural or functional equivalents are anticipated to remain within the spirit and scope of the presently disclosed systems and methods.

What is claimed is:

1. A microtube heat exchanger for cooling or heating refrigerant fluid of a heat exchange system, the microtube heat exchanger comprising:

a tube stack comprising a plurality of microtubes aligned substantially parallel to each other to form the tube stack, wherein refrigerant fluid is configured to pass though the plurality of microtubes so that heat can be transferred between the refrigerant fluid and an external fluid flowing past an exterior of the plurality of microtubes;

a first header disposed on a first end of the tube stack and comprising an inlet port coupled with a refrigerant fluid inlet of the heat exchanger and through which refrigerant fluid traveling in a first direction is introduced into the tube stack; and a second header disposed at a second end of the tube stack and comprising a second header passage configured to receive refrigerant fluid traveling in the first direction through some of the plurality of microtubes and discharge the received refrigerant fluid in a second direction to some of the plurality of microtubes, wherein the first header further comprises a first header passage configured to receive refrigerant fluid traveling in the second direction through some of the plurality of microtubes and discharge the received refrigerant fluid in the first direction to some of the plurality of microtubes, and wherein the second header further comprises an outlet port configured to receive refrigerant fluid traveling through some of the plurality of microtubes in the first direction and discharge the received refrigerant fluid to a refrigerant fluid outlet of the heat exchanger;

wherein each of the first header passage and the second header passage each comprise:

an inlet surface including an inlet port configured to receive the refrigerant fluid from the tube stack;

an outlet surface including an outlet port configured to discharge the received fluid toward the tube stack; and a channel fluidly coupling the inlet port and the outlet port;

wherein the channel is substantially a 180-degree U-shaped channel fluidly coupling the inlet port and the outlet port; and wherein the channel forms a continuous arc free from 90-degree turns.

2. The microtube heat exchanger of claim 1, wherein, for each of the first header passage and second header passage, the inlet surface and outlet surface are substantially coplanar with each other.

3. The microtube heat exchanger of claim 1, wherein, for each of the first header passage and second header passage:

the inlet surface has a plurality of the inlet ports; and the outlet surface has a plurality of the outlet ports, wherein each of the first header passage and second header passage further comprises a plurality of the channels, each of the plurality of the channels fluidly coupling one of the plurality of the inlet ports to one of the plurality of the outlet ports.

4. The microtube heat exchanger of claim 1, wherein each of the first header passage and the second header passage further comprises a gasket configured to seal against an end plate of the tube stack and fluidly separate the inlet surface and the outlet surface.

5. The microtube heat exchanger of claim 1, wherein:

the first header comprises a plurality of the first header passages and is disposed within an inlet-side housing of the heat exchanger; and the second header comprises a plurality of the second header passages and is disposed within an outlet-side housing of the heat exchanger.

6. The microtube heat exchanger of claim 1, wherein each of the first header passage and second header passage comprises:

a U-turn surface disposed to face the tube stack;

a raised perimeter protruding from the U-turn surface toward the tube stack and comprising a gasket configured to seal against an end plate of the tube stack to form a sealed volume between the U-turn surface and the tube stack, wherein the gasket seals against the end plate such that the U-turn surface and sealed volume are configured to receive refrigerant fluid traveling from a first group of microtubes of the plurality of microtubes and discharge refrigerant fluid to a second group of tubes of the plurality of the microtubes.

7. The microtube heat exchanger of claim 1, wherein the plurality of microtubes have an inner diameter in a range from 254 micrometers to 2,497 micrometers.

8. A microtube heat exchanger for cooling or heating refrigerant fluid of a heat exchange system, the microtube heat exchanger comprising:

a tube stack comprising a plurality of microtubes aligned substantially parallel to each other to form the tube stack, wherein refrigerant fluid is configured to pass though the plurality of microtubes so that heat can be transferred between the refrigerant fluid and an external fluid flowing past an exterior of the plurality of microtubes;

a first header disposed on a first end of the tube stack and comprising an inlet port coupled with a refrigerant fluid inlet of the heat exchanger and through which refrigerant fluid traveling in a first direction is introduced into the tube stack; and a second header disposed at a second end of the tube stack and comprising a second header passage configured to receive refrigerant fluid traveling in the first direction through some of the plurality of microtubes and discharge the received refrigerant fluid in a second direction to some of the plurality of microtubes, wherein the first header further comprises a first header passage configured to receive refrigerant fluid traveling in the second direction through some of the plurality of microtubes and discharge the received refrigerant fluid in the first direction to some of the plurality of microtubes, and wherein the second header further comprises an outlet port configured to receive refrigerant fluid traveling through some of the plurality of microtubes in the first direction and discharge the received refrigerant fluid to a refrigerant fluid outlet of the heat exchanger;

wherein first header passage and the second header passage each comprise a surface segregated into a plurality of separate surface portions by a groove projecting outward from the surface, the separate surface portions each being co-planar with each other, and each of the separate surface portions being an inlet surface including an inlet port or an outlet surface including an outlet port.

9. The microtube heat exchanger of claim 8, wherein the plurality of separate surface portions includes a first portion, a second portion, and a third portion, the second portion having a length measured along the surface that is greater than a sum of a length of the first portion measured along the surface and a length of the third portion measured along the surface.

10. A microtube heat exchanger for cooling or heating refrigerant fluid of a heat exchange system, the microtube heat exchanger comprising:

a tube stack comprising a plurality of microtubes aligned substantially parallel to each other to form the tube stack, wherein refrigerant fluid is configured to pass though the plurality of microtubes so that heat can be transferred between the refrigerant fluid and an external fluid flowing past an exterior of the plurality of microtubes;

a first header disposed on a first end of the tube stack and comprising an inlet port coupled with a refrigerant fluid inlet of the heat exchanger and through which refrigerant fluid traveling in a first direction is introduced into the tube stack; and a second header disposed at a second end of the tube stack and comprising a second header passage configured to receive refrigerant fluid traveling in the first direction through some of the plurality of microtubes and discharge the received refrigerant fluid in a second direction to some of the plurality of microtubes, wherein the first header further comprises a first header passage configured to receive refrigerant fluid traveling in the second direction through some of the plurality of microtubes and discharge the received refrigerant fluid in the first direction to some of the plurality of microtubes, and wherein the second header further comprises an outlet port configured to receive refrigerant fluid traveling through some of the plurality of microtubes in the first direction and discharge the received refrigerant fluid to a refrigerant fluid outlet of the heat exchanger;

wherein each of the first header passage and the second header passage each comprise:

an inlet surface including an inlet port configured to receive the refrigerant fluid from the tube stack;

an outlet surface including an outlet port configured to discharge the received fluid toward the tube stack; and a channel fluidly coupling the inlet port and the outlet port;

wherein the first header passage and the second header passage each further comprise a curved inlet surface transitioning between the inlet surface and the inlet port, and a curved outlet surface transitioning between the outlet surface and the outlet port.

* * * * *